US008382223B2

(12) United States Patent
Yokoyama et al.

(10) Patent No.: US 8,382,223 B2
(45) Date of Patent: Feb. 26, 2013

(54) IMAGE FORMING APPARATUS, IMAGE FORMATION ENABLING OR DISABLING METHOD, AND COMPUTER-READABLE STORAGE MEDIUM

(75) Inventors: Atsushi Yokoyama, Kanagawa (JP); Kohichi Sadano, Kanagawa (JP); Satoshi Miyazaki, Kanagawa (JP); Masaharu Ohtani, Kanagawa (JP); Yoshiaki Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 287 days.

(21) Appl. No.: 12/873,481

(22) Filed: Sep. 1, 2010

(65) Prior Publication Data

US 2011/0057971 A1 Mar. 10, 2011

(30) Foreign Application Priority Data

Sep. 8, 2009 (JP) ..... 2009-207464

(51) Int. Cl.
*B41J 2/195* (2006.01)
*B41J 29/393* (2006.01)

(52) U.S. Cl. ..... 347/7; 347/19

(58) Field of Classification Search ..... 347/7, 9, 347/19, 84, 85
See application file for complete search history.

(56) References Cited

U.S. PATENT DOCUMENTS

| | | | | |
|---|---|---|---|---|
| 7,283,258 | B1 * | 10/2007 | Kuno et al. | 358/1.13 |
| 7,407,243 | B2 | 8/2008 | Sadano | |
| 2008/0246994 | A1 | 10/2008 | Matsumoto et al. | |
| 2009/0027432 | A1 | 1/2009 | Watanabe et al. | |

FOREIGN PATENT DOCUMENTS

| | | |
|---|---|---|
| JP | 2001-191560 | 7/2001 |
| JP | 2003-136759 | 5/2003 |
| JP | 2004-174832 | 6/2004 |
| JP | 2004-330517 | 11/2004 |
| JP | 2006-198969 | 8/2006 |
| JP | 2006-212853 | 8/2006 |

* cited by examiner

*Primary Examiner* — An Do
(74) *Attorney, Agent, or Firm* — IPUSA, PLLC

(57) ABSTRACT

An image forming apparatus includes a computing unit to compute an amount of ink to be used to record raster data if a remaining amount of ink reaches a predetermined amount, and a recording control part to enable the recording if the remaining amount of ink is greater than the amount of ink computed by the computing unit. The recording control part disables the recording if the remaining amount of ink is less than or equal to the amount of ink computed by the computing unit.

20 Claims, 21 Drawing Sheets

FIG.13A

| STATUS INFORMATION | | NORMAL STATE | INK NEAR EMPTY | INK EMPTY |
|---|---|---|---|---|
| SPECIFICATION ON REMAINING INK | INK REMAINING IN INK CARTRIDGE | 0% < (REMAINING AMOUNT) | 0% | 0% |
| | INK REMAINING IN SUB TANK | INK REMAINS | INK REMAINS | NO INK |
| SPECIFICATION ON DISPLAY | LED | □ OFF | ▒ ON IN YELLOW | ■ ON IN RED |
| | PANEL 1ST SCREEN | Recording Possible ■ ■ ■ ■ | Recording Possible ■ ■ ■ | Open Cartridge Cover ■ ■ ■ |
| | PANEL 2ND SCREEN | No Alternate Display | Replace Ink Cartridge ■ ↓ ■ ■ | Replace Ink Cartridge ■ ↓ ■ ■ |

| STATUS INFORMATION | | NORMAL STATE | INK NEAR EMPTY | INK EMPTY | RECORDING END |
|---|---|---|---|---|---|
| USER OPERATION | | INSTRUCT RECORDING | ← | INSTRUCT RECORDING & SELECTION OF FORCED RECORDING BUTTON | – |
| SPECIFICATION ON REMAINING INK | INK REMAINING IN INK CARTRIDGE | 10% < (REMAINING AMOUNT) | 0% < (REMAINING AMOUNT) ≦ 10% | 0% | 0% |
| | INK REMAINING IN SUB TANK | INK REMAINS | INK REMAINS | INK REMAINS | NO INK |
| SPECIFICATION ON DISPLAY | LED | □ OFF | ▦ ON IN YELLOW | ★ BLINK IN RED (3-SEC. INTERVALS) | ■ ON IN RED |
| | PANEL 1ST SCREEN | Recording Possible ■ ■ ■ ■ | Recording Possible ■ ■ ■ | Replace Ink Cartridge ■ ■ ■ | Open Cartridge Cover ■ ■ ■ |
| | PANEL 2ND SCREEN | No Alternate Display | Replace Ink Cartridge ■ ↓ ■ ■ | Or Select Forced Recording ■ ↓ ■ ■ | Replace Ink Cartridge ■ ↓ ■ ■ |

⇩ TEMPORARILY ENABLES RECORDING

FIG.13B

FIG.18

| 2-BIT VALUE | DROP-SIZE INFORMATION |
|---|---|
| 00 | NO INK-JET |
| 01 | SMALL INK DROP |
| 10 | MEDIUM INK DROP |
| 11 | LARGE INK DROP |

IMAGE FORMING APPARATUS, IMAGE FORMATION ENABLING OR DISABLING METHOD, AND COMPUTER-READABLE STORAGE MEDIUM

CROSS-REFERENCE TO RELATED APPLICATIONS

This application claims the benefit of a Japanese Patent Application No. 2009-207464 filed on Sep. 8, 2009, in the Japanese Patent Office, the disclosure of which is hereby incorporated by reference.

BACKGROUND OF THE INVENTION

1. Field of the Invention

The present invention generally relates to image forming apparatuses, image formation enabling or disabling methods, and computer-readable storage media on which computer-readable programs are stored.

2. Description of the Related Art

An ink-jet image forming apparatus is provided with an ink cartridge that stores ink to be supplied to a recording head for forming images on a recording medium, such as paper, by jetting the ink. The ink cartridge may be detachably provided in the image forming apparatus, so that the ink may be supplied by replacing the ink cartridge.

If the recording is carried out until the ink remaining in the ink cartridge runs out, an erroneous recording or a deteriorated recording may occur. For this reason, the image forming apparatus may monitor the amount of ink remaining within the ink cartridge, and display a message urging a user to replace the ink cartridge when the remaining amount of ink approaches a certain amount. In addition, in order to prevent the erroneous or deteriorated recording, the image forming apparatus may restrict the recording when the remaining amount of ink approaches the certain amount.

However, when the ink runs out in the image forming apparatus described above, it may not be possible to carry out the recording if a new ink cartridge cannot be prepared to replace the ink cartridge that has run out of ink, or the recording needs to be carried out urgently.

Accordingly, a method has been proposed to provide in the image forming apparatus a first mode that restricts the recording when the remaining amount of ink approaches the certain amount and a second mode that does not restrict the recording regardless of the remaining amount of ink. The user may select the first mode or the second mode. An example of such a method is proposed in a Japanese Laid-Open Patent Publication No. 2004-174832.

However, according to the proposed method, the erroneous or deteriorated recording may occur before the recording is restricted in the first mode, depending on the amount of ink to be used to record the images in one job, for example.

On the other hand, the ink-jet image forming apparatus may include a sub tank that is connected to the recording head. The ink from the ink cartridge is supplied to the sub tank, and the sub tank supplies the ink to the recording head. In such an image forming apparatus, an amount of ink may remain within the sub tank even when the ink within the ink cartridge runs out. However, the erroneous or deteriorated recording may occur when the ink within the sub tank runs out before the ink cartridge is replaced, depending on the amount of ink to be used to record the images in one job, for example.

SUMMARY OF THE INVENTION

Accordingly, it is a general object in one embodiment of the present invention to provide a novel and useful image forming apparatus, image formation enabling or disabling method, and computer-readable storage medium, in which the problem described above may be suppressed.

Another and more specific object in one embodiment of the present invention is to provide an image forming apparatus, an image formation enabling or disabling method, and a computer-readable storage medium, which prevent an erroneous or deteriorated recording even when a remaining amount of ink in the image forming apparatus becomes small and approaches a certain amount.

According to one aspect of one embodiment, there is provided an image forming apparatus including an ink amount managing part configured to manage a remaining amount of ink remaining within the image forming apparatus; a storage unit configured to store raster data of image data to be recorded for a recording job; a computing unit configured to compute an amount of ink to be used to record the raster data stored in the storage unit if the remaining amount of ink managed by the ink amount managing part reaches a predetermined amount; and a recording control part configured to enable the recording if the remaining amount of ink managed by the ink amount managing part is greater than the amount of ink computed by the computing unit, and to disable the recording if the remaining amount of ink managed by the ink amount managing part is less than or equal to the amount of ink computed by the computing unit.

According to one aspect of one embodiment, there is provided an image formation enabling or disabling method to enable or disable recording of image data for a recording job in an image forming apparatus, including managing a remaining amount of ink remaining within the image forming apparatus; storing raster data of image data to be recorded for a recording job in a storage unit; computing an amount of ink to be used to record the raster data stored in the storage unit if the managed remaining amount of ink reaches a predetermined amount; and enabling the recording if the managed remaining amount of ink is greater than the computed amount of ink, and disabling the recording if the managed remaining amount of ink is less than or equal to the computed amount of ink.

According to one aspect of one embodiment, there is provided a computer-readable storage medium which stores a program which, when executed by a computer, causes the computer of an image forming apparatus to carry out an image formation enabling or disabling process, the process including a managing procedure causing the computer to manage a remaining amount of ink remaining within the image forming apparatus; a storing procedure causing the computer to store raster data of image data to be recorded for a recording job in a storage unit; a computing procedure causing the computer to compute an amount of ink to be used to record the raster data stored in the storage unit if the managed remaining amount of ink reaches a predetermined amount; and a recording enabling and disabling procedure causing the computer to enable the recording if the managed remaining amount of ink is greater than the computed amount of ink, and to disable the recording if the managed remaining amount of ink is less than or equal to the computed amount of ink.

Other objects and further features of the present invention will be apparent from the following detailed description when read in conjunction with the accompanying drawings.

BRIEF DESCRIPTION OF THE DRAWINGS

FIGS. 13A and 13B are diagrams for explaining LED displays and the panel displays with respect to a remaining amount of ink in the image forming apparatus;

FIG. 18 is a diagram for explaining drop-size information included in raster data;

DESCRIPTION OF THE PREFERRED EMBODIMENTS

A description will be given of embodiments of the image forming apparatus, the image formation enabling or disabling method, and the computer-readable storage medium according to embodiments of the present invention.

Figure 1:
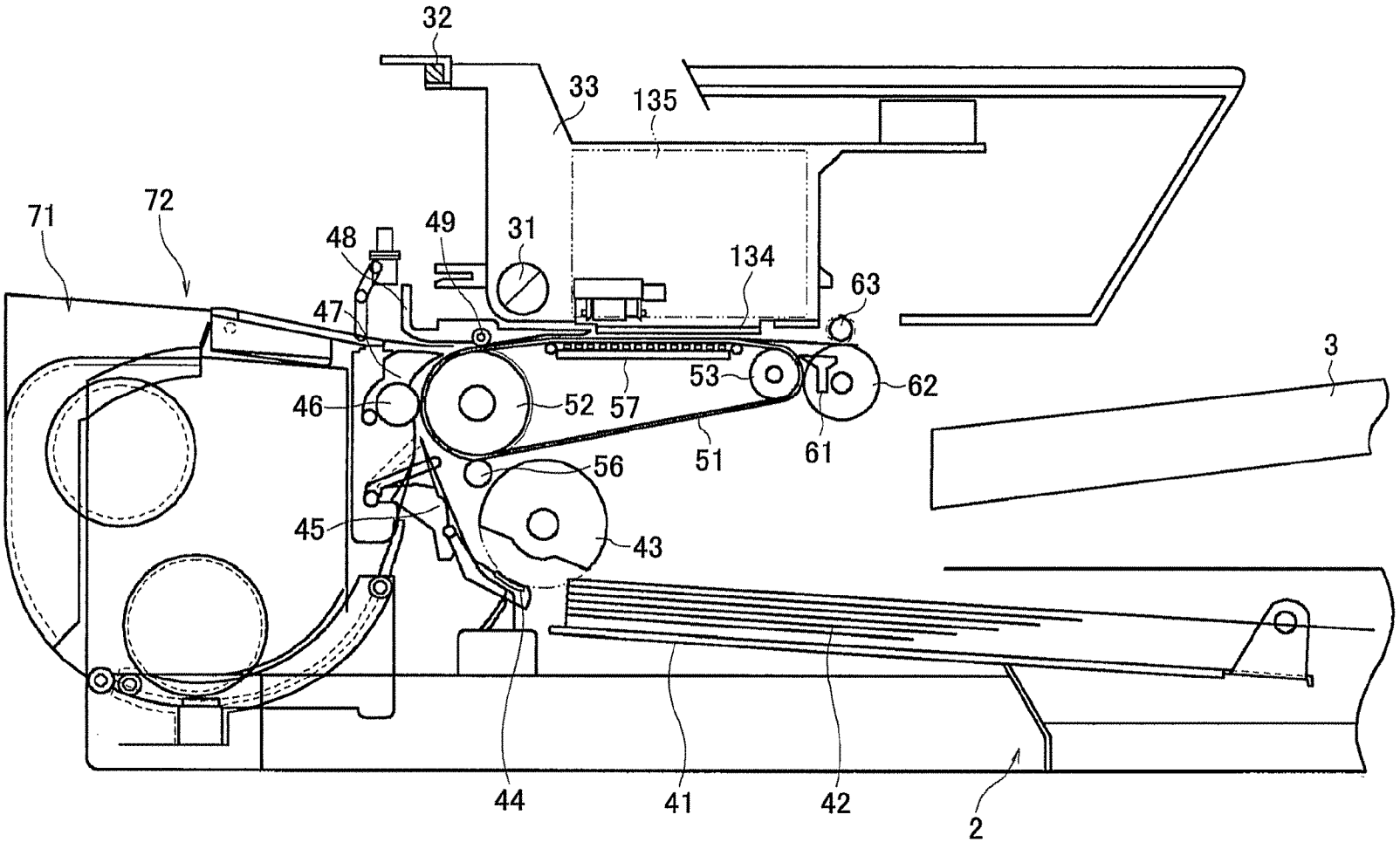
FIG. 1 is a side view in partial cross section illustrating an example of a structure of an image forming apparatus in one embodiment of the present invention.
Figure 2:
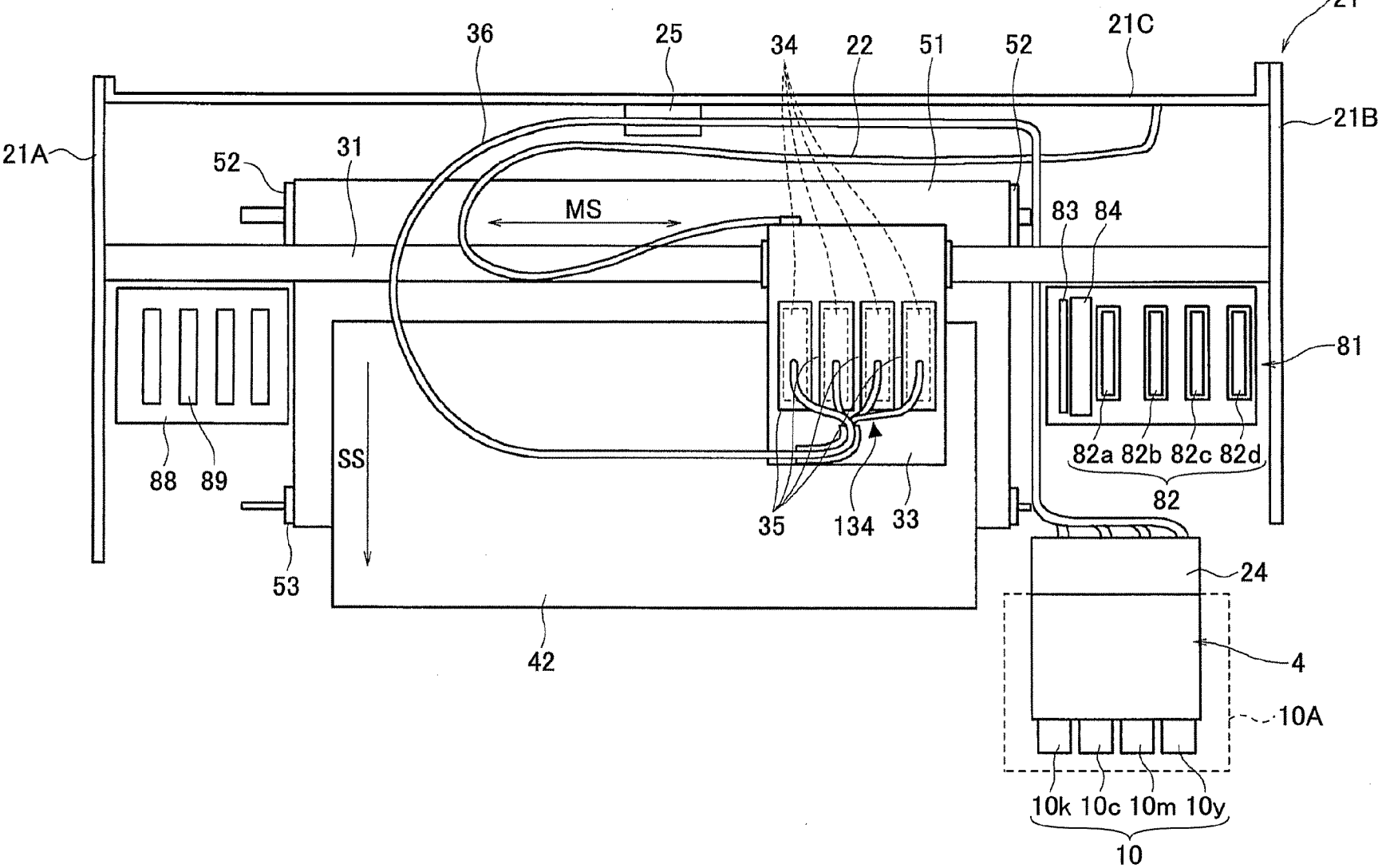
FIG. 2 is a plan view illustrating a part of the image forming apparatus.

FIG. 1 is a side view in partial cross section illustrating an example of a structure of an image forming apparatus in one embodiment of the present invention, and FIG. 2 is a plan view illustrating a part of the image forming apparatus. A description will be given of an internal mechanical structure of the image forming apparatus. In one embodiment, the image forming apparatus may be formed by an ink-jet recording apparatus or an ink-jet printer.

In FIGS. 1 and 2, a frame 21 is formed by right and left side plates 21B and 21A, and a rear plate 21C. A guide rod 31 and a stay 32 are supported between the side plates 21A and 21B, and a carriage 33 is slidably supported on the guide rod 31. The carriage 33 is driven by a driving mechanism (not illustrated) including a main scan motor and a timing belt, and scans in a main scan direction MS illustrated in FIG. 2.

A recording head part 134 is provided on the carriage 33. The recording head part 134 includes four (4) recording heads 34 that are formed by ink-jet heads that are configured to jet yellow (Y), cyan (C), magenta (M), and black (Bk) ink drops, respectively. One or a plurality of nozzles of each of the ink-jet heads are arranged in a direction perpendicular to the main scan direction MS, so that each nozzle faces downwards in FIG. 1 or into the paper in FIG. 2.

The ink-jet heads of the recording head part 134 may use a pressure generating unit (or pressure generating means) that is configured to generate a pressure in order to jet the ink drops from the nozzles thereof. The pressure generating unit may include a piezoelectric actuator such as a piezoelectric element, a thermal actuator utilizing a phase change of liquid film boiling by use of an electro-thermal conversion element such as a heating resistor, a shape memory alloy actuator utilizing a metal phase change by use of a temperature change, an electrostatic actuator utilizing electrostatic force, or the like. The recording head part 134 includes a driver IC (Integrated Circuit, not illustrated), and this driver IC is coupled to a control part (not illustrated) or the like using a harness or FPC (Flexible Printed Circuit or Cable) 22.

In one embodiment, the nozzles may be driven substantially simultaneously or driven time-divisionally. The simultaneous driving of the nozzles may deteriorate the recording quality due to the effects of crosstalk among the nozzles, and may temporarily require a large current which in turn may require a large-capacity power supply. On the other hand, the time-divisional driving of the nozzles may suppress the deterioration in the recording quality and the requirement for the large current, which may be encountered when simultaneously driving the nozzles.

A sub tank part 135 is provided on the carriage 33. The sub tank part 135 includes four (4) sub tanks 35 for storing yellow (Y), cyan (C), magenta (M), and black (Bk) ink, respectively. A cartridge part 10 includes four (4) ink cartridges 10*y*, 10*m*, 10*c*, and 10*k* for storing yellow (Y), cyan (C), magenta (M), and black (Bk) ink, respectively. The ink cartridges 10*y*, 10*m*, 10*c*, and 10*k* are loaded into a cartridge loading part 4. The yellow (Y), cyan (C), magenta (M), and black (Bk) ink from the ink cartridges 10*y*, 10*m*, 10*c*, and 10*k* is pumped out by a pump unit (not illustrated) of the cartridge loading part 4 and supplied to the corresponding sub tanks 35 for storing yellow (Y), cyan (C), magenta (M), and black (Bk) ink via corresponding ink supply tubes 36. The ink supply tubes 36 are held on the rear plate 21C by a holding member 25.

A cartridge cover 10A covers the cartridge part 10. More particularly, the cartridge cover 10A may cover the ink cartridges 10*y*, 10*m*, 10*c*, and 10*k*, and may additionally cover at least a part of the cartridge loading part 4. The cartridge cover 10A in an open state thereof enables each of the ink cartridges 10*y*, 10*m*, 10*c*, and 10*k* to be replaced, that is, loaded into the cartridge loading part 4 or unloaded from the cartridge loading part 4. On the other hand, the cartridge cover 10A in a closed state thereof protects the ink cartridges 10*y*, 10*m*, 10*c*, and 10*k*.

A medium supply part supplies recording media 42, such a paper, stacked on a stacking part 41 of a medium supply tray 2. The medium supply part may include a medium supply roller 43 that is configured to separate and supply each recording medium 42 from the stack of the recording media on the stacking part 41, and a separation pad 44. The separation pad 44 is formed by a material having a sufficiently large coefficient of friction, and is urged towards the medium supply roller 43.

A guide member 45, a counter roller 46, a transport guide member 47, and a pressing member 48 provided with a tip end pressing roller 49 are provided in order to guide and supply the recording medium 42 supplied from the medium supply part to a position under the recording head part 134. A transport belt 51, which forms a transport mechanism or a transport means, is provided to electrostatically adhere the supplied recording medium 42 thereon and transport the recording medium 42 to a position opposing the recording head part 134.

The transport belt 51 may be formed by an endless belt that is provided between a transport roller 52 and a tension roller 53. The transport belt 51 is driven to revolve in a belt transport direction which corresponds to a sub scan direction SS indicated in FIG. 2. The transport belt 51 may include a surface layer not subjected to a resistance control and having a pure (or even) thickness on the order of approximately 40 μm, and a back layer subjected to a resistance control. For example, the surface layer may be formed by resin such as a ETFE pure material, to form an adhesion surface on which the recording medium 42 is electrostatically adhered. The back layer may be formed by the same material as the surface layer, and the back layer may be subjected to the resistance control using carbon. The back layer may also be referred to as an intermediate resistance layer or a ground layer.

A charging roller 56 forms a charging unit or a charging means, and charges the surface of the transport belt 51. The charging roller 56 is arranged to make contact with the surface layer of the transport belt 51 and to rotate as the transport belt 51 revolves. A pressing force is applied on both ends of a shaft supporting the charging roller 56. The transport roller 52 also functions as a grounding roller, and is arranged to make contact with and ground the back layer of the transport belt 51.

A guide member 57 is arranged to guide the back surface of the transport belt 51 in a region corresponding to a recording region of the recording head part 134. The guide member 57 projects more towards the recording head part 134 than a common tangent to the rollers 52 and 53, in order to maintain the surface layer of transport belt 51 flat in the recording region.

The transport belt 51 is driven by a sub scan motor (not illustrated) which rotates the transport roller 52, so that the transport belt 51 revolves in the belt transport direction, that is, moves to transport the recording medium 42 in the sub scan direction SS.

The recording medium 42 recorded with images or the like is ejected to a medium eject part. The medium eject part includes a separation finger 61 to separate the recording medium 42 from the transport belt 51, and medium eject rollers 62 and 63. A medium eject tray 3 is arranged at a position generally below the medium eject roller 62 in FIG. 1. A distance from the medium eject tray 3 to a position where the medium eject rollers 62 and 63 contact each other along a vertical direction in FIG. 1 may be set so that a certain amount of recording media 42 may be stacked on the medium eject tray 3.

A duplex unit 71 is detachably provided on the left of the transport belt 51 in FIG. 1. The duplex unit 71 receives the recording medium 42 that is returned when the transport belt 51 revolves in a reverse direction. The duplex unit 71 turns over the recording medium 42 that is received, and feeds the turned over recording medium 42 between the counter roller 46 and the transport belt 51. A manual feed tray 72 is provided on top of the duplex unit 71 as illustrated in FIG. 1.

In addition, a recovery mechanism 81 is arranged in a non-recording region on one side along the main scan direction MS of the carriage 33. In FIG. 2, the recovery mechanism 81 is arranged on the right side of the transport belt 51. The recovery mechanism 81 may include a recovery unit or a recovery means that is configured to maintain the recordable state (or ink-jet state) of the nozzles of the recording head part 134. The recovery unit of the recovery mechanism 81 of this example includes a cap part 82, a wiper blade 83, and a waste ink receiving part 84. The cap part 82 may include caps 82*a* through 82*d* that are configured to cap the nozzle surfaces of the four (4) recording heads 34. The wiper blade 83 is configured to wipe and clean the nozzle surfaces of the four (4) recording heads 34. The waste ink receiving part 84 is configured to receive ink drops that are jetted from the nozzles but do not contribute to the recording, in order to eject the ink with increased viscosity or clean the nozzles. The cap 82*a* may be used to suck the ink from one recording head 34 and to maintain nozzle surface of the recording head 34 wet (or moist), and the other caps 82*b* through 82*d* may be used to maintain the nozzle surface of the recording heads 34 wet.

On the other hand, a waste ink receiving part 88 is arranged in a non-recording region on the other side along the main scan direction MS of the carriage 33. In FIG. 2, the waste ink receiving part 88 is arranged on the left side of the transport belt 51. The waste ink receiving part 88 is configured to receive ink drops that are jetted from the nozzles but do not contribute to the recording, in order to eject the ink with increased viscosity during the recording operation, for example. The waste ink receiving part 88 includes openings 89, and each opening 89 extends in the direction in which the nozzles of the corresponding recording head 34 are arranged.

A communication circuit part (or interface part, not illustrated) and a circuit board (not illustrated) forming the control part is provided in a rear part of the image forming apparatus. The communication circuit part may be formed by a USB (Universal Serial Bus) device that is configured to transmit data to and receive data from a host unit. The control part may be configured to control the general operation of the image forming apparatus.

In the image forming apparatus having the structure described heretofore, the recording medium 42 is separated one by one and supplied from the medium supply tray 2. The recording medium 42 is supplied generally in an upward direction in FIG. 1, guided by the guide member 45, and transported between the transport belt 51 and the counter roller 46. Then, the tip end of the recording medium 42 is guided by transport guide member 47, and pushed against the transport belt 51 by the tip end pressing roller 49, to thereby change the transport direction of the recording medium 42 by approximately 90 degrees.

In this state, a positive output and a negative output are alternately and repeatedly supplied, that is, an AC voltage is supplied to the charging roller 56 from an AC bias supply part by a control carried out by the control part. Hence, an alternating charged voltage pattern is formed on the transport belt 51. The alternating charged voltage pattern is formed by band-shaped patterns of predetermined widths that are alternately charged by positive and negative charges in the sub scan direction SS. The recording medium 42 adheres on the charged surface of the transport belt 51 having the alternating charged voltage pattern, and the recording medium 42 is transported in the sub scan direction SS as the transport belt 51 revolves in the belt transport direction.

When the recording head part 134 is driven according to an image signal while moving the carriage 33 in the main scan direction MS, one line is recorded by the ink jetted on the recording medium 42 while the recording medium 42 is stationary. After transporting the recording medium 42 by a predetermined amount in the sub scan direction SS, the recording head part 134 records the next line on the recording medium 42. The control part ends the recording operation upon receipt of a recording end signal or a signal indicating the arrival of the rear end of the recording medium 42 in the recording region of the recording head part 134, and ejects the recording medium 42 onto the medium eject tray 3.

In a recording standby state, for example, the carriage 33 may move to the recovery mechanism 81 to cap the recording head part 134 by the cap part 82 and maintain the nozzle surfaces wet, in order to prevent drying of the ink at the nozzle surface and prevent irregular ink-jet from the nozzle. A suction pump (not illustrated) of the recovery mechanism 81 may suck the ink from the nozzles of the recording head part 134 that is capped by the cap part 82, in order to carry out a recovery operation and eject ink with increased viscosity or air bubbles mixed into the ink. In addition, prior to starting a recording operation or during the recording operation, the head part 134 may eject ink that does not contribute to the recording into the waste ink receiving part 84. Hence, the stable ink-jet operation of the recording head part 134 may be maintained.

Figure 3:
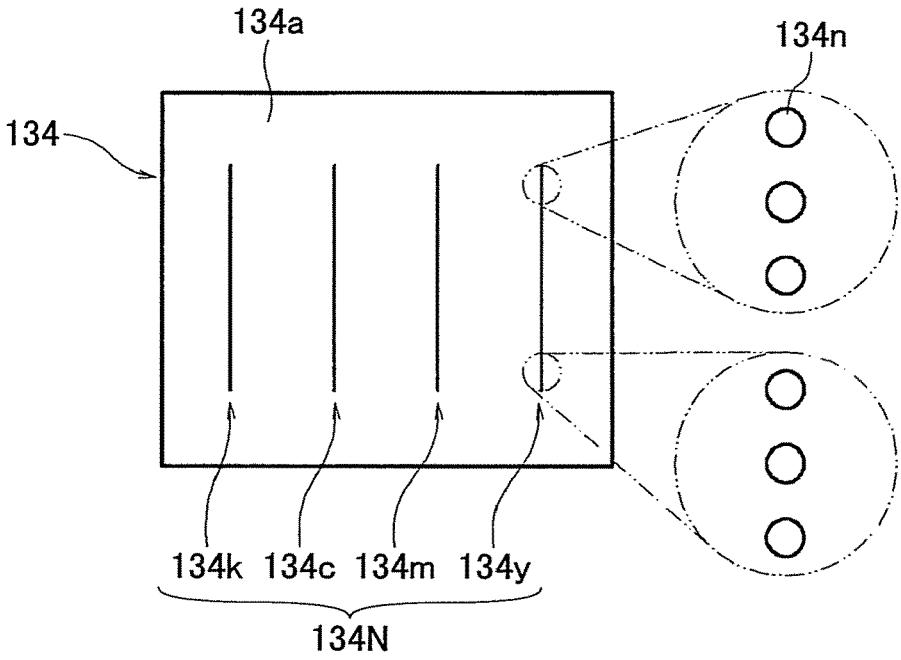
FIG. 3 is a diagram illustrating a recording head part of the image forming apparatus viewed from a nozzle surface.

FIG. 3 is a diagram illustrating the recording head part 134 of the image forming apparatus viewed from the nozzle surface. The recording head part 134 includes a nozzle surface 134*a*, and four (4) nozzle columns 134*y*, 134*m*, 134*c*, and 134*k* for jetting yellow (Y), magenta (M), cyan (C) and black (Bk) ink arranged on the nozzle surface 134*a*. Each of the nozzle columns 134*y*, 134*m*, 134*c*, and 134*k* extends in the sub scan direction SS, and includes a plurality of nozzles 134*n*. Portions of the nozzle column 134*y* are enlarged within circles indicated by two-dot chain lines to illustrate the nozzles 134*n*. In the following description, an arbitrary one of the nozzle columns 134*y*, 134*m*, 134*c*, and 134*k* may be referred to as a nozzle column 134N.

Figure 4:
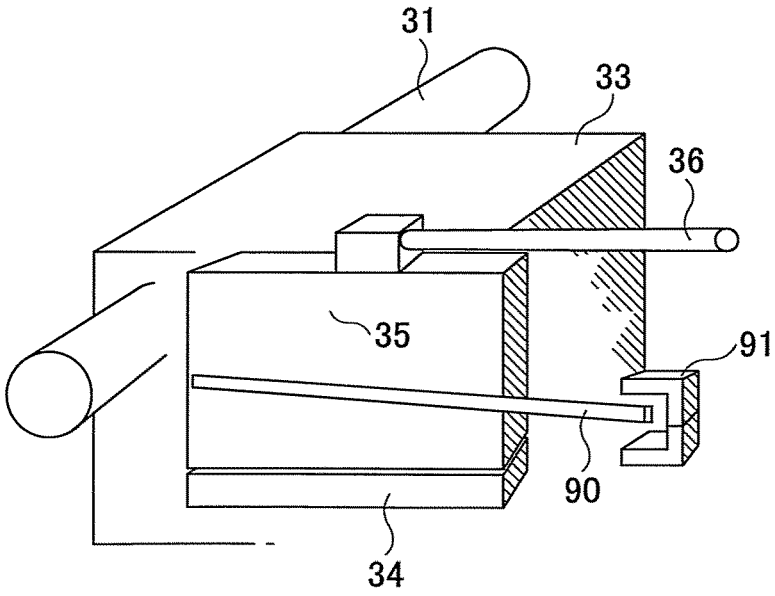
FIG. 4 is a perspective view illustrating a structure of the recording head part and sub tanks provided on a carriage of the image forming apparatus.

FIG. 4 is a perspective view illustrating an example of a structure of the recording head part 134 and sub tanks 35 provided on the carriage 33 of the image forming apparatus. Each sub tank 35 of the sub tank part 135 includes a level indicator 90 that is configured to indicate a level of the ink stored within the sub tank 35. For example, a full state of the sub tank 35 or, a state where a remaining amount of ink stored within the sub tank 35 exceeds a predetermined amount, may be detected by a sensor 91 when the level indicator 90 indicates a maximum level. The sensor 91 is not limited to a particular type, and an optical sensor, a magnetic sensor, a mechanical sensor or the like may be used therefor.

Figure 5:
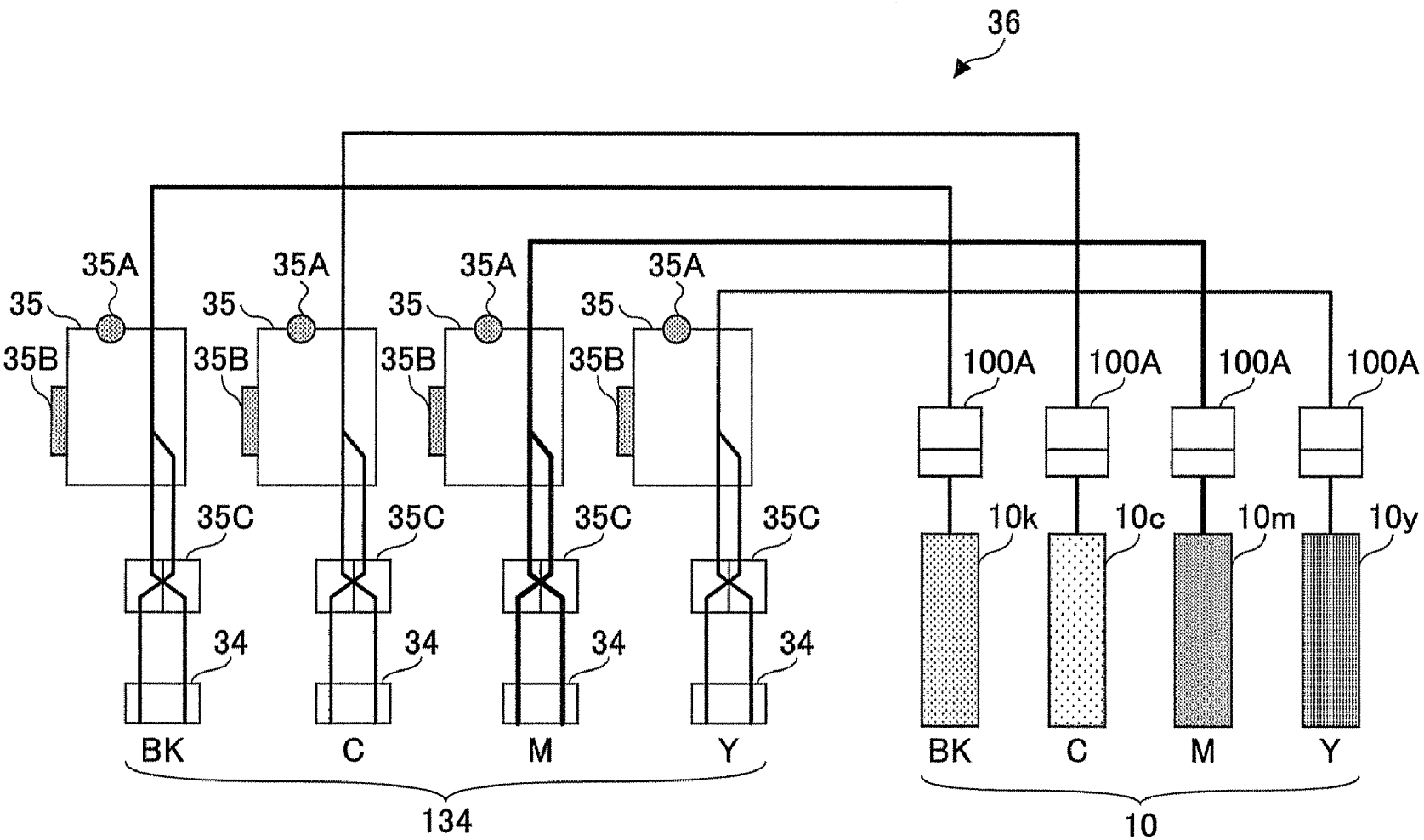
FIG. 5 is a diagram illustrating an example of a structure of ink cartridges and the sub tanks of the image forming apparatus.

FIG. 5 is a diagram illustrating an example of a structure of ink cartridges 10*y*, 10*m*, 10*c*, and 10*k* and the sub tanks 35 of the image forming apparatus. In the example illustrated in FIG. 5, the recording head part 134 includes, in addition to the recording heads 34, the sub tank 35 and a filter unit 35C that are provided with respect to each recording head 34. An air detection sensor 35A and a level detection unit 35B are provided on the sub tank 35. The air detection sensor 35A detects air bubbles into the ink, and outputs a detection signal when the air bubbles are detected. The level detection unit 35B may detect the remaining amount of ink within the sub tank 35. The level detection unit 35B may be formed by a combination of the level indicator 90 and the sensor 91 illustrated in FIG. 4.

The filter unit 35C is provided in an ink supply passage to the recording head 34, in order to remove foreign particles within the ink. The sub tank 35 stores in advance the ink that is to be jetted from the nozzles of the corresponding recording head 34 when carrying out the recording operation. Each pump unit 100A is provided between the head part 134 and the corresponding one of the ink cartridges 10*y*, 10*m*, 10*c*, and 10*k*. The pump unit 100A may be provided in the cartridge loading part 4 and supply the ink from the corresponding one of the ink cartridges 10*y*, 10*m*, 10*c*, and 10*k* to the corresponding one of the sub tanks 35 via the corresponding one of the ink supply tubes 36. If the air detection sensor 35A detects the air bubbles within the ink, the control part in response to the detection signal may control the head part 134 to jet the ink that does not contribute to the recording in order to remove the air bubbles, and control the pump unit 100A in order to supply the ink to the sub tank 35 and supplement the amount of ink used to remove the air bubbles.

Figure 6:
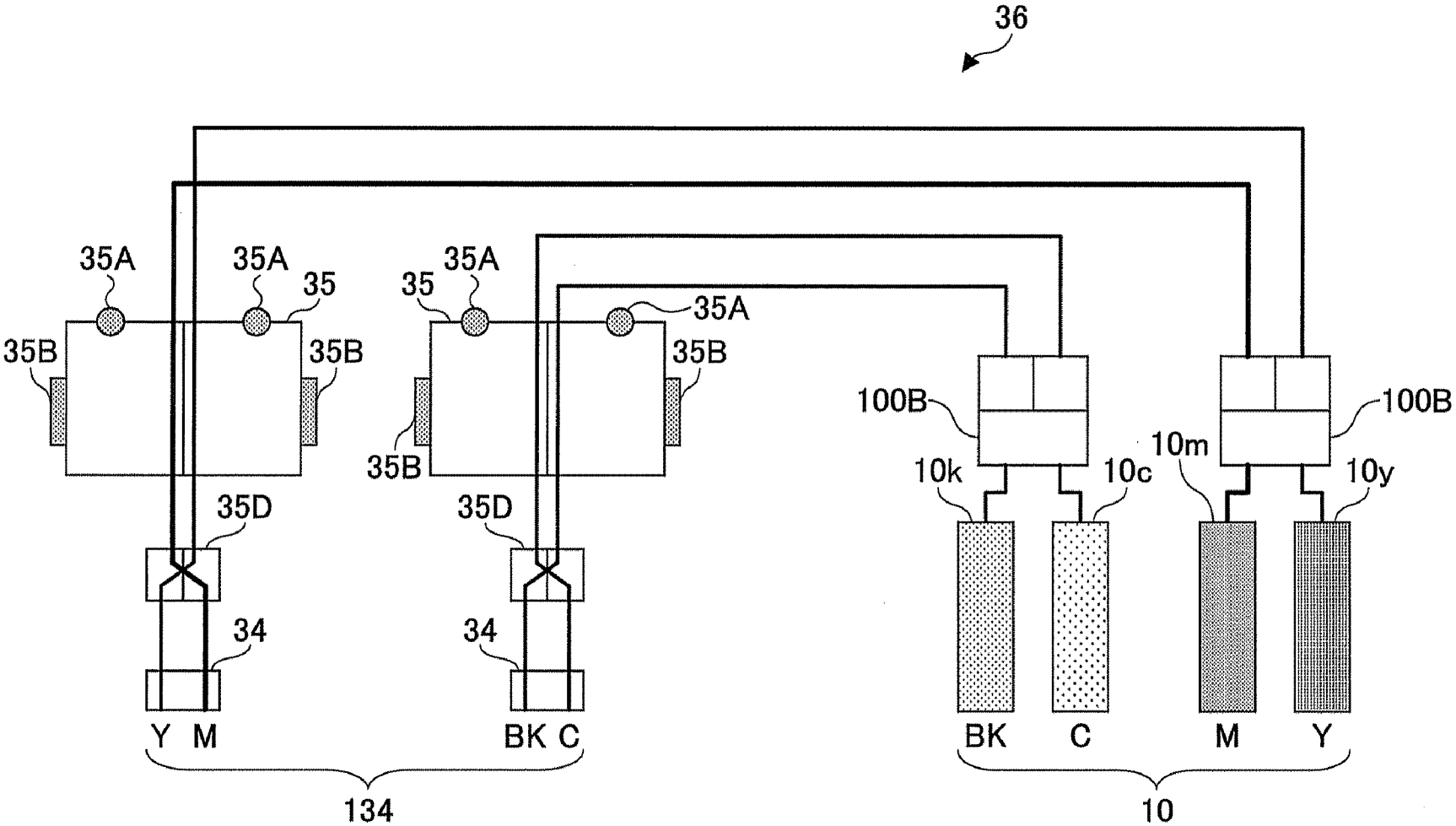
FIG. 6 is a diagram illustrating another example of the structure of the ink cartridges and the sub tanks of the image forming apparatus.

FIG. 6 is a diagram illustrating another example of the structure of the ink cartridges 10*y*, 10*m*, 10*c*, and 10*k* and the sub tanks 35 of the image forming apparatus. In FIG. 6, those parts that are the same as those corresponding parts in FIG. 5 are designated by the same reference numerals, and a description thereof will be omitted. In FIG. 6, a single filter unit 35D having separate ink passages for the different ink colors is used to filter the yellow and magenta ink. Similarly, a single filter unit 35D having separate ink passages for the different ink colors is used to filter the black and cyan ink. The recording heads 34 for the yellow and magenta ink are integrally provided, however, the sub tanks 35 for the yellow and magenta ink may or may not be integrally provided. The recording heads 34 for the black and cyan ink are integrally provided, however, the sub tanks 35 for the black and cyan ink may or may not be integrally provided. Each pump unit 100B has two channels for pumping ink of two different colors.

A head cleaning operation may be carried out in the image forming apparatus to eliminate clogging or clean the nozzle surface of the recording heads 34, in order to maintain a sufficiently high recording quality of the images or the like recorded by the recording operation. The head cleaning operation may be started in response to an instruction input by the user or, at a suitable timing depending on the state of the recording heads 34 that may be automatically predicted from the amount of ink jetted from the recording heads 34, the number of recording media 42 recorded by the recording heads 34, the time for which the image forming apparatus is continuously not used, and the like. The head cleaning operation may utilize the recovery mechanism 81 located on one side along the main scan direction MS of the carriage 33, and additionally utilize the waste ink receiving part 88 and the openings 89 located on the other side along the main scan direction MS of the carriage 33.

Figure 7:
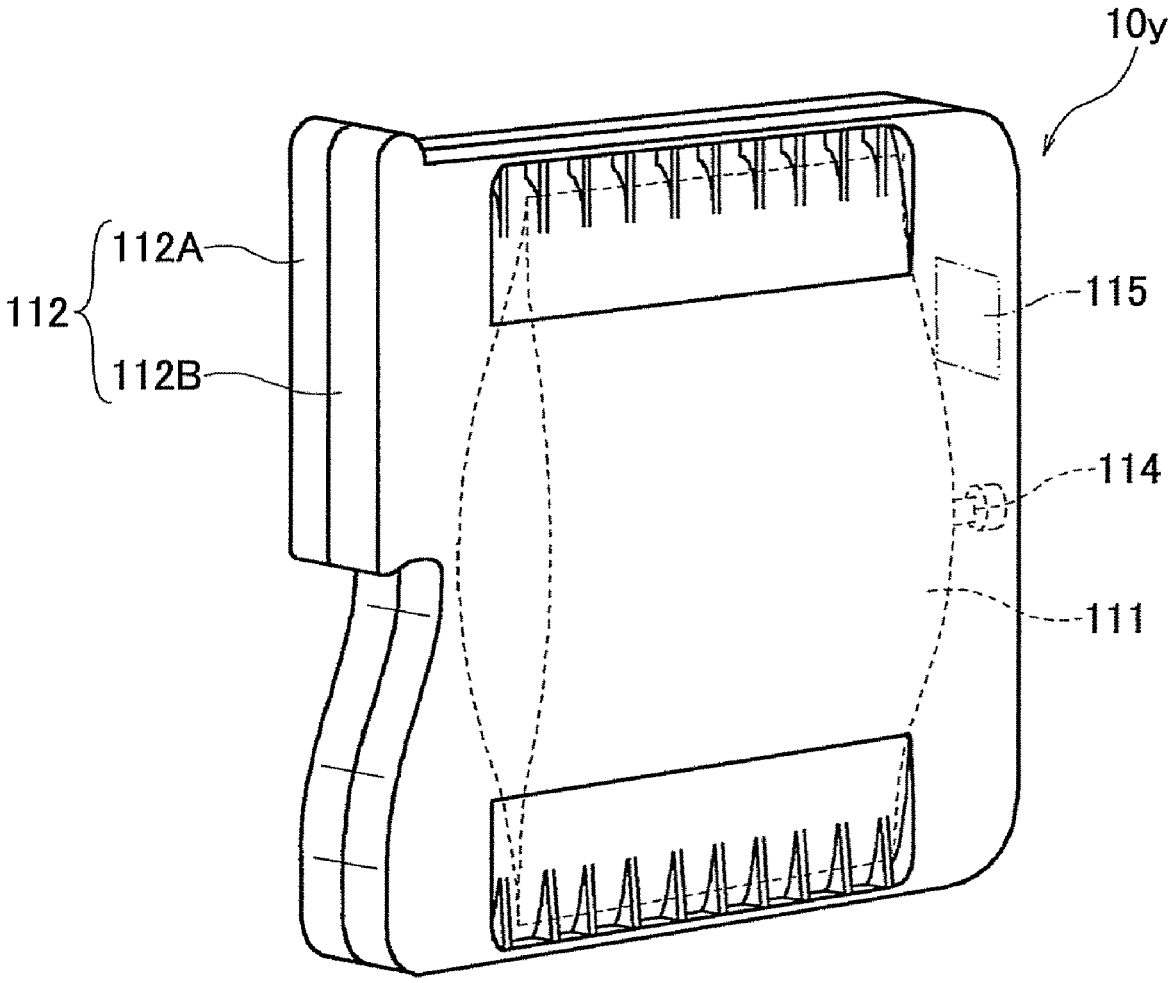
FIG. 7 is a perspective view illustrating an example of the ink cartridge of the image forming apparatus.

FIG. 7 is a perspective view illustrating an example of the ink cartridge 10*y* of the image forming apparatus. The ink cartridges 10*m*, 10*c*, and 10*k* may have the same structure as the ink cartridge 10*y*.

The ink cartridge 10*y* illustrated in FIG. 7 may include an ink bag 111 that is configured to accommodate ink, and a casing 112 that is configured to detachably accommodate the ink bag 111. The casing 112 may be formed by at least two casing parts 112A and 112B for respectively protecting side surfaces of the ink bag 111. In this example, surfaces of the casing parts 112A and 112B supporting the ink bag 111 are parallel to the ink supplying direction, that is, the direction in which the ink is supplied.

The ink bag 111 includes an ink outlet 114 that engages an ink supply needle (or pin, not illustrated) of the cartridge loading part 4 when the ink cartridge 10*y* is loaded into the cartridge loading part 4. The ink outlet 114 is provided on a rear surface of the casing 112, and a non-volatile memory 115 is provided on this rear surface in a vicinity of the ink outlet 114. The non-volatile memory 115 may be formed by an EEPROM (Electrically Erasable Programmable Read Only Memory), for example. The non-volatile memory 115 may form a storage unit or a storage means that is configured to store information unique to the ink cartridge 10*y* using a known technique. The information unique to the ink cartridge 10*y* may include, and is not limited to, the color of the ink, the type of ink, the date by which the ink should preferably be used, the amount of ink remaining within the ink cartridge 10*y*, and the ID (IDentification) number. When the ink cartridge 10*y* is loaded into the cartridge loading part 4, terminals of the non-volatile memory 115 make electrical contact with contacts of the cartridge loading part 4 that are electrically connected to the control part of the image forming apparatus, and the information stored in the non-volatile memory 115 is read and supplied to the control part.

Figure 8:
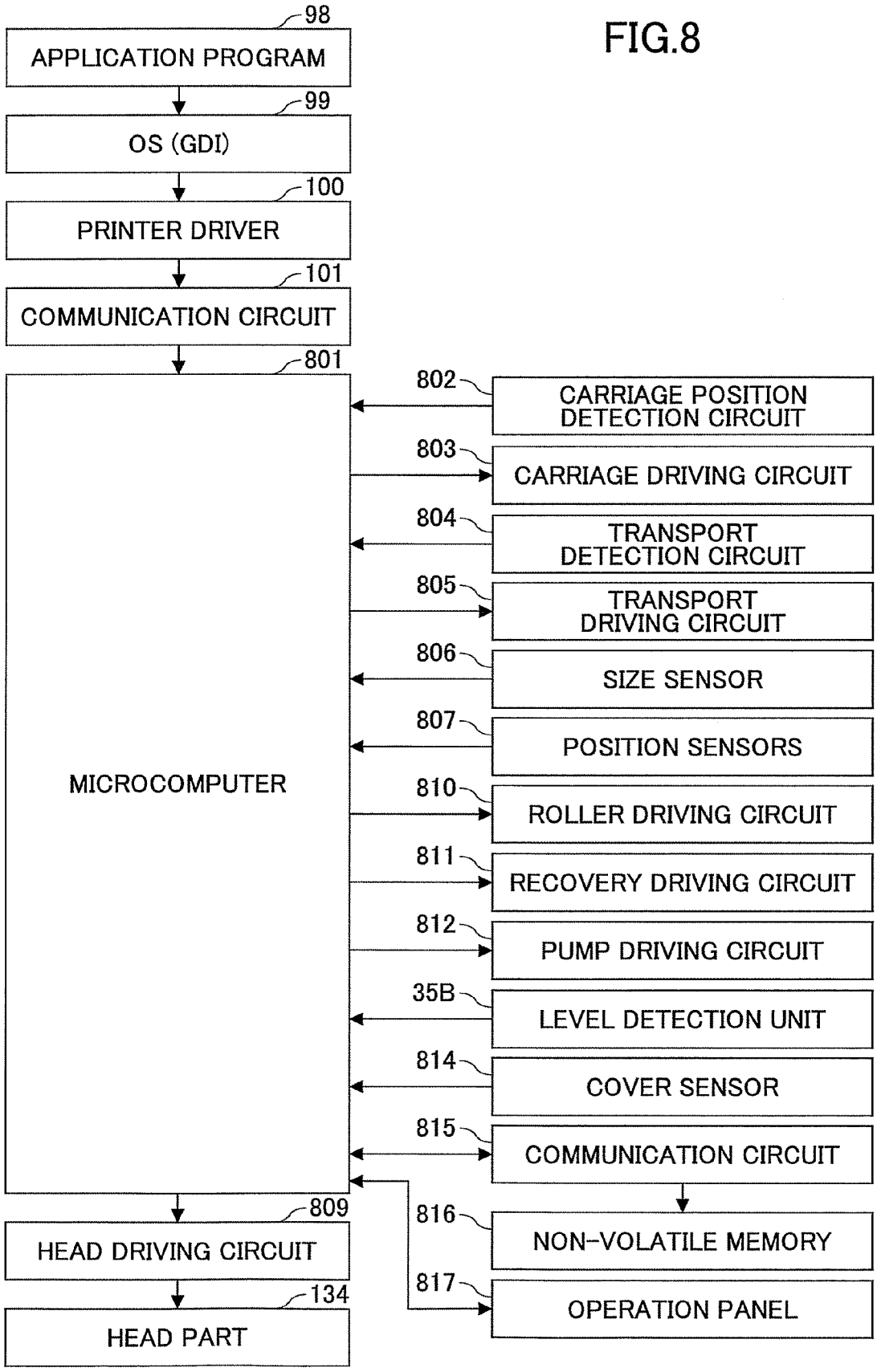
FIG. 8 is a block diagram illustrating a control part of the image forming apparatus.

FIG. 8 is a block diagram illustrating the control part of the image forming apparatus. The control part illustrated in FIG. 8 includes a microcomputer 801.

When a record (or print) instruction is input by the user through an application program 98, an OS (Operating System) 99 transmits the image data to be recorded on the image forming apparatus to a printer driver 100. In this example, the OS 99 is formed by a GDI (Graphic Device Interface) implemented in a Windows (registered trademark) OS such as the Windows XP. The printer driver 100 converts the image data received from the application program 98 into image data having a format suited for the recording operation of the image forming apparatus, and inputs the converted, recording image data to the microcomputer 801 via a communication circuit 101.

The microcomputer 801 carries out a control to form images on the recording medium 42 based on the recording image data input from the communication circuit 101. The control includes controlling the main scan motor and the sub scan motor via a carriage driving circuit 803 and a transport driving circuit 805, respectively, and generating and supplying the data to drive the pressure generating unit to a head driving circuit 809 in order to control the jetting of the ink from the recording head 34.

The microcomputer 801 receives a detection signal from a carriage position detection circuit 802 that is configured to detect the position of the carriage 33, and controls the moving position and the moving speed of the carriage 33 based on this detection signal. For example, the carriage position detection circuit 802 may detect the position of the carriage 33 by reading and counting the number of slits of an encoder sheet that is arranged in the main scan direction MS of the carriage 33 by a photosensor provided on the carriage 33. The carriage driving circuit 803 is configured to rotate the main scan motor according to the moving amount of the carriage 33 input from the microcomputer 801, in order to move the carriage 33 at a predetermined speed to a predetermined position.

The microcomputer 801 receives a detection signal from a transport detection circuit 804 that is configured to detect the moving amount of the transport belt 51, and controls the moving amount and the moving speed of the transport belt 51 based on this detection signal. For example, the transport detection circuit 804 may detect the moving amount of the transport belt 51 by reading and counting the number of slits of a rotary encoder sheet that is provided on a rotary shaft of the transport roller 52 by a photosensor. The transport driving circuit 805 is configured to rotate the sub scan motor according to the moving amount of the transport belt 51 input from the microcomputer 801, in order to rotate the transport roller 52 at a predetermined speed to a predetermined position.

The microcomputer 801 controls the medium supply roller 43 to make one revolution by inputting a medium supply roller driving instruction to a roller driving circuit 810. The microcomputer 801 drives a recovery motor (not illustrated) of the recovery mechanism 84 via a recovery driving circuit 811, in order to raise or lower the caps 82*a* through 82*d* and to activate the wiper blade 83.

The microcomputer 801 drives the pump unit 100A of the cartridge loading part 4 via a pump driving circuit 812, in order to supply the ink to the sub tank 35 from the ink cartridge 10*y*, for example, that is loaded into the cartridge loading part 4.

The microcomputer 801 receives a detection signal from the level detection unit 35B (or the sensor 91) that may detect a full state of the sub tank 35, and a detection signal from a cover sensor 814 that detects an open or closed state of the cartridge cover 10A which is configured to cover the ink cartridges 10*y*, 10*m*, 10*c*, and 10*k* and at least a part of the cartridge loading part 4.

The microcomputer 801 reads the information stored in the non-volatile memory 115 of each of the ink cartridges 10*y*, 10*m*, 10*c*, and 10*k* that are loaded into the cartridge loading part 4, via a communication circuit 815. The microcomputer 801 subjects the information read from the non-volatile memory 115 to a predetermined signal processing, in order to store the processed information in a non-volatile memory 816 that is provided within the image forming apparatus. The non-volatile memory 816 may be formed by an EEPROM, for example. The non-volatile memory 816 may form a storage unit or a storage means that is configured to store the processed information originating from the ink cartridges 10*y*, 10*m*, 10*c*, and 10*k*.

The head driving circuit 809 drives the pressure generating unit of the recording head part 134 based on the recording image data received from the microcomputer 801, in order to jet the ink from the corresponding nozzles of the recording heads 34.

The microcomputer 801 receives a detection signal from a size sensor 806 that is configured to detect the size of the recording medium 42. Based on this detection signal from the size sensor 806, the microcomputer 801 may determine whether the recording image data may be recorded in its entirety on the recording medium 42 or, trim the recording image data to fit the size of the recording medium 42 if some of the recording image data may extend outside the recording medium 42 upon recording. The size of the recording medium 42 may be detected using any known technique. For example, if a reflection sensor forming the size sensor 806 is arranged on the side of the carriage 33, the width of the recording medium 42 along the main scan direction MS may be detected from a difference between the reflectances of the recording medium 42 and the transport belt 42 when the carriage 33 moves, based on the detection signal from the reflection sensor. In addition, if a line sensor forming the size sensor 806 is arranged along the main scan direction MS in a transport path of the recording medium 42, the width of the recording medium 42 along the main scan direction MS may be detected from the detection signal from the line sensor. Further, if a reflection sensor forming the size sensor 806 is arranged on the side of the carriage 33, the length of the recording medium 42 along the sub scan direction SS may be detected by detecting the recording medium 42 from a difference between the reflectances of the recording medium 42 and the transport belt 42 when the carriage 33 moves, and detecting the moving amount of the transport belt 42 from the detection of the recording medium 42, based on the detection signal from the reflection sensor.

The microcomputer 801 may detect the position of the recording medium 42 within the image forming apparatus, based on detection signals received from a plurality of position sensors 807 that are arranged in the transport path of the recording medium 42. If the recording medium 42 is located at an undesirable position within the image forming apparatus, the microcomputer 801 may detect a jam in the transport path based on the detection signals from the position sensors 807 and alarm the user, for example. The microcomputer 801 may also indicate the position of the jam to the user based on the detection signals from the position sensors 807.

An operation panel 817 includes an input part and a display part. The input part includes buttons or the like that are manipulated by the user to input data and instructions. The display part includes a display panel, indicators such as LEDs (Light Emitting Diodes) and the like, and is configured to display menus, messages and the like with respect to the user. For example, the operation panel 817 may be formed by a touchscreen panel which integrally includes the input part and the display part. On the other hand, the operation panel 817 may be formed by the input part and the display part that are separately provided.

Various known sensors or detectors may be used for the sensors or detectors described above. In addition, the location of each sensor or detector within the image forming apparatus may be determined depending on the structure of the image forming apparatus, and a known arrangement or location may be employed for each sensor or detector.

In the image forming apparatus including the sub tanks, the ink is first supplied from the ink cartridge to the sub tank, and the ink is then supplied from the sub tank to the recording head. In this type of ink supplying system, the recording is possible as long as the sub tank contains the ink. But normally, the recording is disabled when the ink in the ink cartridge runs out, because the recording head may be damaged if the recording is continued even after the ink in the sub tank runs out. In other words, after the ink in the ink cartridge runs out and the recording is disabled, the recording normally may not be resumed until the ink cartridge is replaced by a new ink cartridge that contains sufficient ink.

Figure 9:
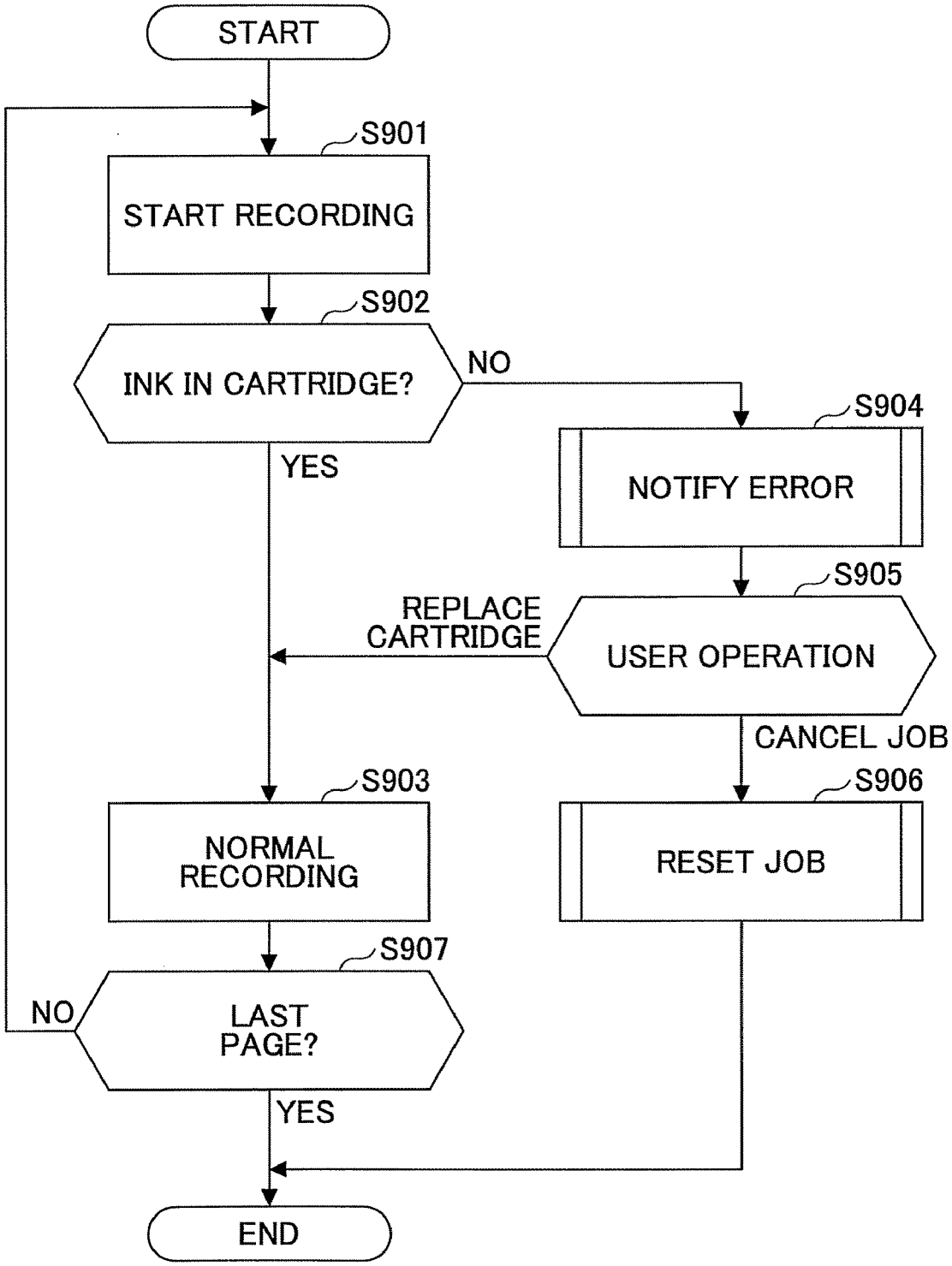
FIG. 9 is a flow chart for explaining a normal process of the image forming apparatus when ink within the ink cartridge runs out.

FIG. 9 is a flow chart for explaining a normal process of the image forming apparatus when ink within the ink cartridge runs out In FIG. 9, a step S901 starts a recording operation, and a step S902 decides whether the remaining amount of ink in each of the ink cartridges 10*y*, 10*m*, 10*c*, and 10*k* is greater than a predetermined amount. If the decision result in the step S902 is YES, a step S903 carries out a normal recording operation using the ink in the ink cartridges 10*y*, 10*m*, 10*c*, and 10*k*.

On the other hand, if the decision result in the step S902 is NO, a step S904 stops the recording operation and notifies an error state of at least one of the ink cartridges 10*y*, 10*m*, 10*c*, and 10*k* to the user by displaying an error on the display part of the operation panel 817. A step S905 causes the user to either select replacing the at least one ink cartridge or, select ending the recording operation by cancelling the requested recording (or print) job that remains to be made. If the user selects to replace the at least one ink cartridge, the process advances to the step S903 and the recording operation is continued after the at least one ink cartridge is replaced. On the other hand, if the user selects to end the recording operation, a step S906 resets the recording job to end the recording operation, and the process ends. After the step S903, a step S907 decides whether the last page of the recording job has been recorded. The process returns to the step S901 if the decision result in the step S907 is NO, in order to start recording the next page of the recording job. On the other hand, the process ends if the decision result in the step S907 is YES.

However, when the ink runs out in one ink cartridge of the image forming apparatus that operates as illustrated in FIG. 9, it may not be possible to carry out the recording if a new ink cartridge cannot be prepared to replace the ink cartridge that has run out of ink, or the recording needs to be carried out urgently in order to record only one page or several pages.

Figure 10:
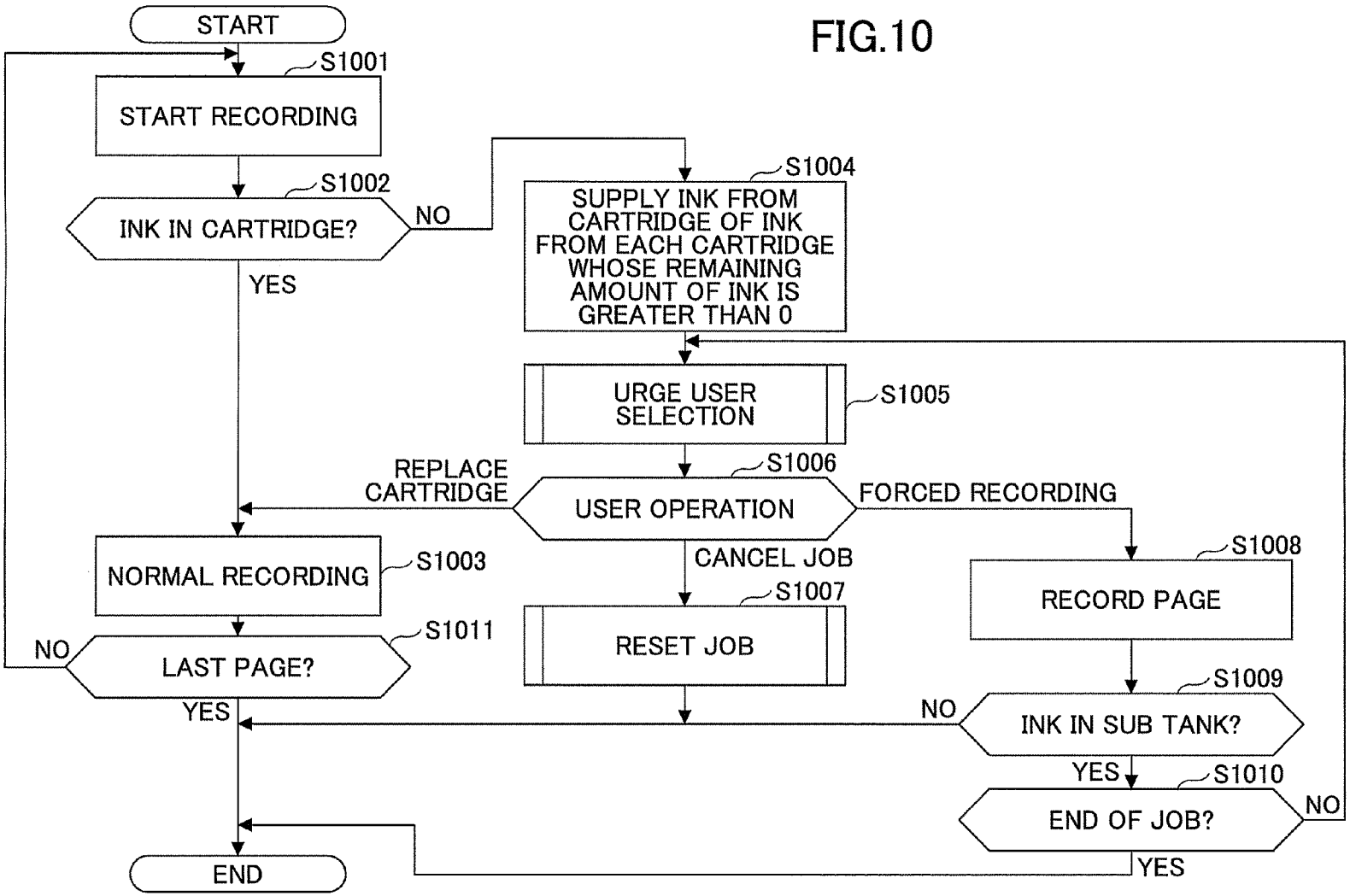
FIG. 10 is a flow chart for explaining a process of the image forming apparatus in one embodiment of the present invention.

FIG. 10 is a flow chart for explaining a process of the image forming apparatus in one embodiment of the present invention, which includes a forced recording (or urgent recording) function in order to prevent an erroneous or deteriorated recording even when the remaining amount of ink in the image forming apparatus becomes small and approaches a predetermined amount. Of course, in one embodiment, an operation mode of the image forming apparatus may be selectable from an operation mode to carry out the normal process illustrated in FIG. 9 and an operation mode to carry out the process illustrated in FIG. 10.

In FIG. 10, a step S1001 starts a recording operation, and a step S1002 decides whether the remaining amount of ink in each of the ink cartridges 10*y*, 10*m*, 10*c*, and 10*k* is greater than a predetermined amount. If the decision result in the step S1002 is YES, a step S1003 carries out a normal recording operation using the ink in the ink cartridges 10*y*, 10*m*, 10*c*, and 10*k*.

On the other hand, if the decision result in the step S1002 is NO, a step S1004 temporarily stops the recording operation and supplies the ink from each ink cartridge whose remaining amount of ink is greater than zero (0). A step S1005 urges the user to make a selection on whether the page presently being recorded is to be executed, by displaying a message or the like on the display part of the operation panel 817. In this example, it is assumed for the sake of convenience that the user may select to replace the ink cartridge that has run out of ink or, to cancel the recording job or, to carry out a forced recording. A step S1006 decides which selection has been made by the user.

The user may select to replace the ink cartridge if the user can immediately prepare a new ink cartridge and replace the ink cartridge that has run out of ink by the new ink cartridge. In this case, from the step S1006, the process advances to the step S1003 after the ink cartridge is replaced.

The user may select to cancel the recording job if a new ink cartridge cannot be prepared immediately. In this case, from the step S1006, the process advances to a step S1007 which reset the recording job, and the process ends.

The user may select to carry out the forced recording if a new ink cartridge cannot be prepared immediately but at least one page is to be recorded while the new ink cartridge is being prepared. Further, the user may wish to record at least one more page even if the new ink cartridge cannot be prepared. In this case, from the step S1006, the process advances to a step S1008 which carries out the forced recording to continue recording one more page.

After the step S1008, a step S1009 decides whether the remaining amount of ink in each of the sub tanks 35 is greater than a predetermined amount. If the decision result in the step S1009 is NO, the process ends. Of course, a step may be carried out to urge the user to replace the ink cartridge before ending the process.

If the remaining amount of ink in each of the sub tanks 35 is greater than the predetermined amount even after carrying out the forced recording to record one more page, the decision result in the step S1009 becomes YES, and the process advances to a step S1010. The step S1010 decides whether the recording job has ended. If the decision result in the step S1010 is NO, the process returns to the step S1005 to urge the user to make the selection described above. The process ends if the decision result in the step S1010 is YES. Hence, the forced recording is carried out one page at a time, and the remaining amount of ink in the sub tanks 35 is checked each time one additional page is recorded. Further, if the remaining amount of ink in the sub tanks 35 is sufficient, the user is urged to make the selection on whether to continue the forced recording.

After the step S1003, a step S1011 decides whether the last page of the recording job has been recorded. The process returns to the step S1001 if the decision result in the step S1011 is NO, in order to start recording the next page of the recording job. On the other hand, the process ends if the decision result in the step S1011 is YES.

In FIG. 10, the recording is carried out with respect to the request to record the data amounting to one page, and the user is urged to make the selection every time the recording of one page ends. However, if a duplex recording is requested and the forced recording is carried out with respect to the first side to be recorded, the steps S1005 and S1006 may be omitted with respect to the second side to be recorded in order to unconditionally continue the recording with respect to the second side to be recorded.

The forced recording is carried out using the ink in the sub tanks 35. For this reason, a maintenance operation that consumes a relatively large amount of ink may not be carried out during the forced recording. If the maintenance operation is carried out during the forced recording that is to additionally record only one more page, for example, the head cleaning operation or the like may use up the ink in the sub tank and the ink in the sub tank may run out before the additional one page is recorded.

Hence, when carrying out the forced recording, the user may select completion of the recording of the requested page with a priority over the recording quality of the requested page, in order to discontinue the operation that is other than the recording and consumes the ink, such as the head cleaning operation. The head cleaning operation at the time of the forced recording may be discontinued with respect to all of the ink cartridges 10*y*, 10*m*, 10*c*, and 10*k* or, with respect to each ink cartridge that has run out of the ink. For example, in the case of the ink cartridges 10*y*, 10*m*, 10*c*, 10*k* and the recording head part 134 having the structure illustrated in FIG. 5, the head cleaning operation may be discontinued or continued depending on the remaining amount of ink in each of the ink cartridges 10*y*, 10*m*, 10*c*, and 10*k*.

In one embodiment, the decision on whether to continue the recording is made every time the recording of one page ends. For this reason, the recording quality will not be deteriorated considerably from the time when the user starts the recording until the time when the recording is discontinued. If the user decides whether to continue the recording every time the recording of one page ends, the user may confirm the state of the recording every time the recording of one page ends. Thus, the recording may be carried out while maintaining the recording quality desired by the user.

When replacing the ink cartridge, the cartridge cover 10A is opened in order unload the ink cartridge that has run out of ink from the cartridge loading part 4, and to load the new ink cartridge into the cartridge loading part 4. The cartridge cover 10A is not provided separately for each of the ink cartridges 10*y*, 10*m*, 10*c*, and 10*k*. Accordingly, as will be described later, measures may be taken to prevent ink cartridges that has not run out of ink from being erroneously unloaded from the cartridge loading part 4 in the open state of the cartridge cover 10A.

Figure 11:
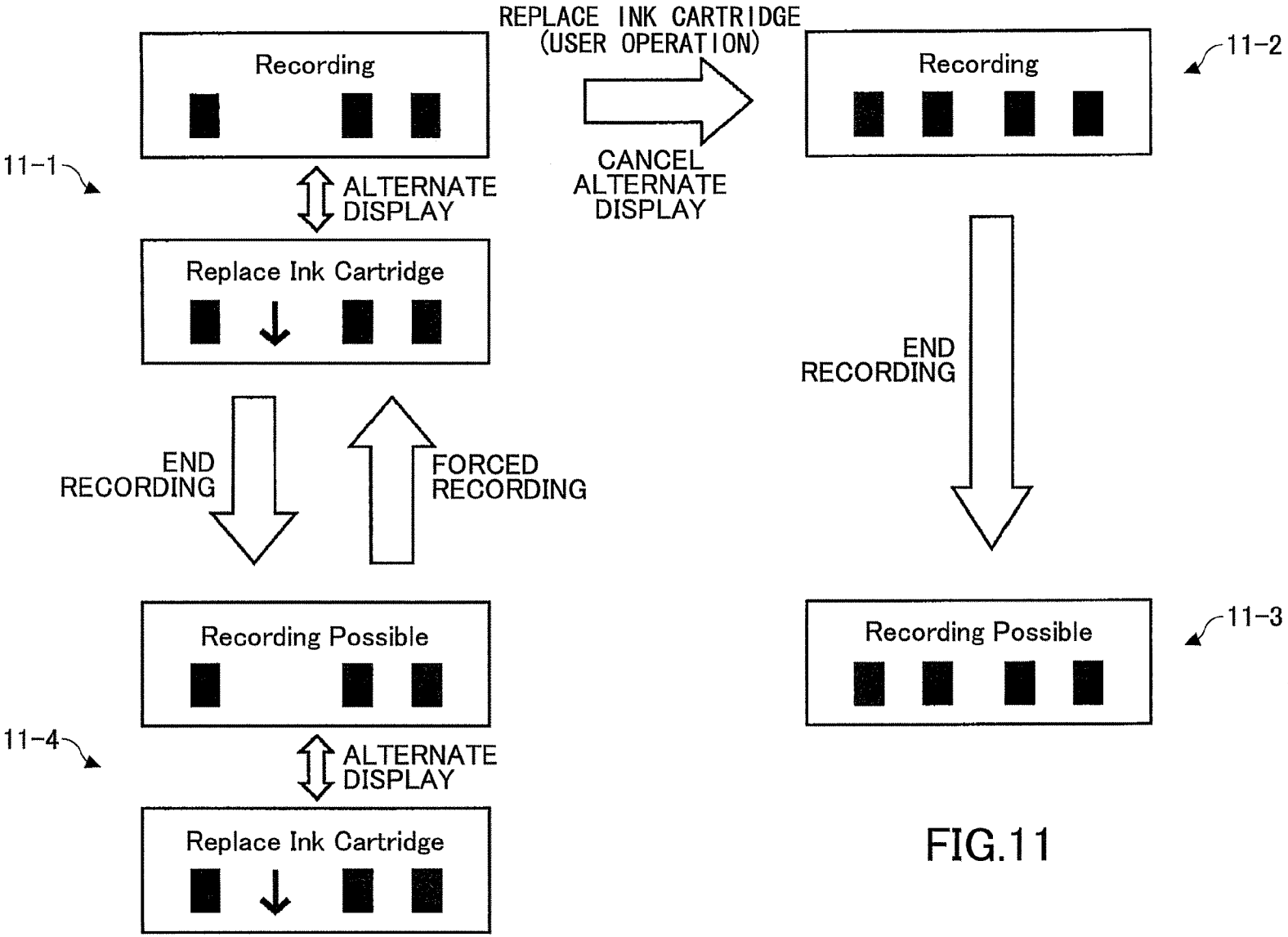
FIG. 11 is a diagram illustrating panel displays of the image forming apparatus.

FIG. 11 is a diagram illustrating displays made on the display part of the operation panel 817, that is, panel displays, of the image forming apparatus. As described above, when the ink in the ink cartridge runs out during the recording, the user may select to replace the ink cartridge by a new ink cartridge or, to cancel the recording job or, to carry out the forced recording.

A top left part 11-1 of FIG. 11 illustrates the panel display for a case where the user selects the forced recording. When the user selects the forced recording, the image forming apparatus makes a transition to the image formation enabling state (or recording enabling state), and resumes the recording by a forced recording function thereof. In this state, one of the ink cartridges 10*y*, 10*m*, 10*c*, and 10*k* loaded in the cartridge loading part 4 is empty and has run out of ink, and the number of recordable pages using the ink within the sub tank 35 is limited. Hence, in order to notify the user that the ink cartridge needs to be replaced, a display "Recording" and a display "Replace Ink Cartridge" are alternately made on the display part of the operation panel 817, for example, in order to urge the user to replace the ink cartridge.

A top right part 11-2 of FIG. 11 illustrates the panel display for a case where the user has replaced the ink cartridge by the new ink cartridge and the recording has continued. The user prepares the new ink cartridge while the recording is continued by the forced recording, opens the cartridge cover 10A, and replaces the ink cartridge that has run out of ink by the new ink cartridge. When the replacement of the ink cartridge by the new ink cartridge is completed, the image forming apparatus makes a transition from the state where the ink cartridge has run out of ink to the normal recording state. Hence, the panel display urging the user to replace the ink cartridge is discontinued, and a display "Recording" is made on the display part of the operation panel 817, for example, in order to notify the user that the image forming apparatus has returned to the normal recording state.

A bottom right part 11-3 of FIG. 11 illustrates the panel display for a case where none of the ink cartridges 10*y*, 10*m*, 10*c*, and 10*k* loaded in the cartridge loading part 4 has run out of ink. When the recording ends, a display "Recording Possible" is made on the display part of the operation panel 817, for example, in order to notify the user that the image forming apparatus is in the standby state that may accept a recording job.

A bottom left part 11-4 of FIG. 11 illustrates the panel display for a case where the ink has run out in at least one of the ink cartridges 10*y*, 10*m*, 10*c*, and 10*k* loaded in the cartridge loading part 4 and the image forming apparatus is in the standby state. While the forced recording is being continued, the recording may be completed before the user prepares the new ink cartridge. In this case, the empty ink cartridge will remain loaded in the cartridge loading part 4 even after the forced recording is carried out. Hence, in order to notify the user that the ink cartridge needs to be replaced, a display "Recording Possible" and a display "Replace Ink Cartridge" are alternately made on the display part of the operation panel 817, for example, in order to notify the user that the image forming apparatus is in the standby state and to urge the user to replace the ink cartridge. If the user selects the forced recording in this state, the image forming apparatus makes a transition to the recordable state, and the panel display may become as illustrated in the top left part 11-1 of FIG. 11 to alternately make the display "Recording" and the display "Replace Ink Cartridge" on the display part of the operation panel 817, for example.

Figure 12:
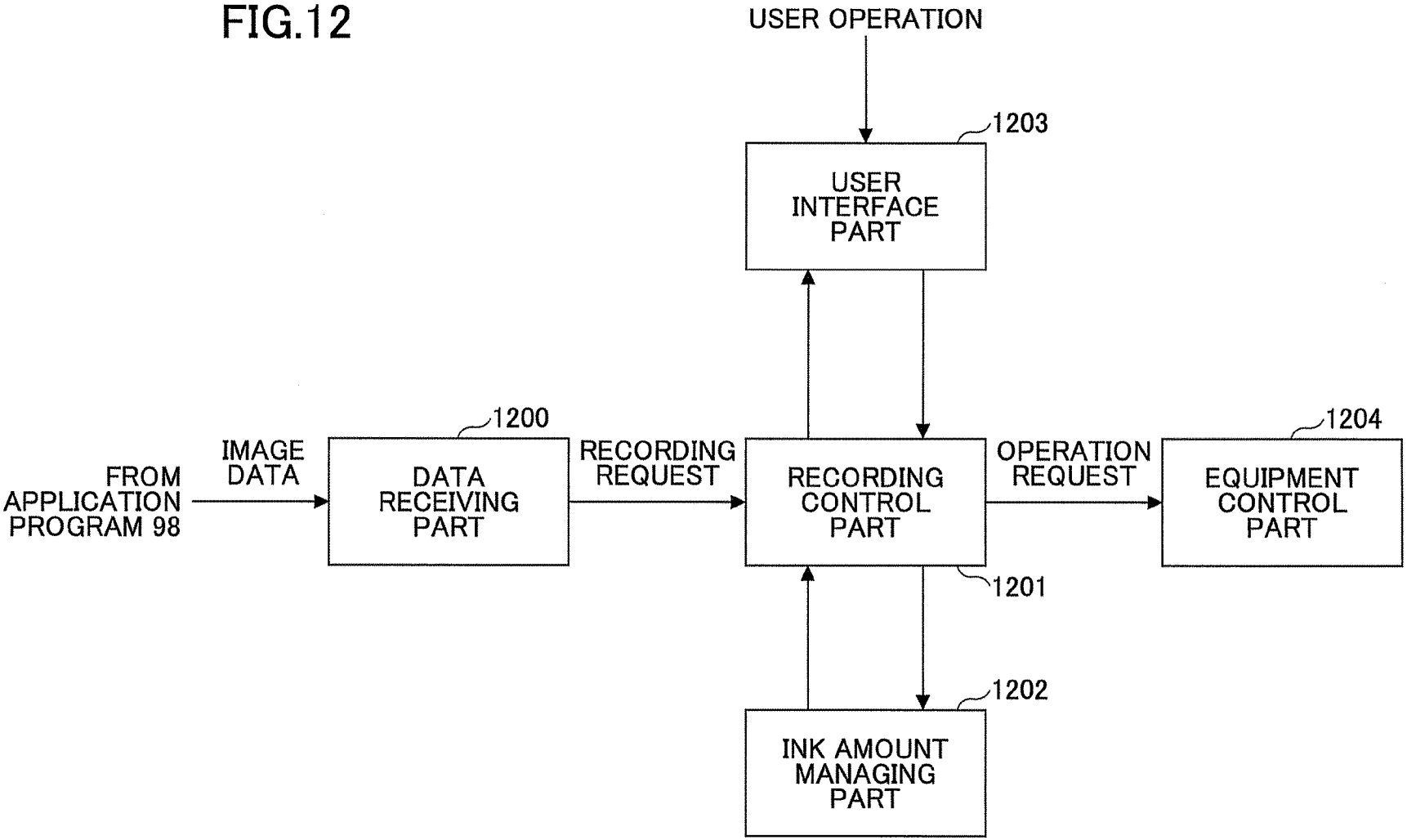
FIG. 12 is a functional block diagram illustrating a recording control process of the image forming apparatus.

FIG. 12 is a functional block diagram illustrating a recording control process of the image forming apparatus. The functional blocks illustrated in FIG. 12 may be formed by the microcomputer 801 illustrated in FIG. 8.

When the user inputs the recording instruction via the application program 98, the OS (or GDI) 99 transmits the image data to be recorded to the printer driver 100. The printer driver 100 converts the image data received from the application program 98 into the recording image data having the format suited for the recording operation of the image forming apparatus, and inputs the recording image data to the microcomputer 801 via the communication circuit 101. More particularly, the recording image data is input to the recording control part 1201 via a data receiving part 1200.

The recording control part 1201 inquires a remaining amount of ink to an ink amount managing part 1202 that is configured to manage the remaining amount of ink within the sub tank 35 of the image forming apparatus, and decides whether to enable the recording or to disable the recording based on the remaining amount of ink. If the remaining amount of ink within the sub tank 35 notified from the ink amount managing part 1202 is such that the recording may be temporarily enabled by the user operation, that is, the forced recording may be enabled, a notification is sent to a user interface part 1203 to indicate that a user instruction to enable or disable the recording is awaited. The user interface part 1203 may be coupled to the operation panel 817. Thus, the user interface part 1203 may function as a displaying part or a displaying means that is configured to make a display on the display part of the operation panel 817 to urge the user to select whether the recording is to be enabled or disabled. In addition, the user interface part 1203 may also function as an inputting part or an inputting means that is configured to receive the input from the input part of operation panel 817 and indicating the selection made by the user. If the user selects the forced recording, the recording control part 1201 again decides whether to enable the recording or to disable the recording, as described above. In addition, if the user selects the forced recording, the recording control part 1201 supplies an operation request to an equipment control part 1204 in order to start the recording operation. On the other hand, if the user selects the cancelling of the recording job, the recording image data held in the control part of the image forming apparatus, such as in an internal memory of the microcontroller 801 or the non-volatile memory 816, is deleted or discarded.

FIGS. 13A and 13B are diagram for explaining LED displays and the panel displays on the operation panel 817 with respect to the remaining amount of ink in the standby state of the image forming apparatus.

In the operation mode to carry out the normal process illustrated in FIG. 9, the operating state (or status information) may be categorized into three (3) kinds, namely, "normal", "ink near empty", and "ink empty" states. In the "normal" state, both the ink cartridge and the sub tank contain ink. In the "normal" state, a color identification notification using the LED and the panel display are made on the operation panel 817 with respect to the user. For example, as illustrated in FIG. 13A, the LED of the operation panel 817 is turned OFF to indicate the "normal" state, and the panel display "Recording Possible" is made on the operation panel 817 to indicate the "normal" state.

In the "ink near empty" state, the ink cartridge contains no ink (that is, the amount of ink within the ink cartridge is 0%) but the sub tank contains ink. For example, as illustrated in FIG. 13A, the LED of the operation panel 817 is made to turn ON in yellow to indicate the "ink near empty" state with respect to the user. In addition, the panel display "Recording Possible" and the panel display "Replace Ink Cartridge" are alternately made on the operation panel 817 to indicate the "ink near empty" state with respect to the user. In other words, in the "ink near empty" state, the recording is possible but the ink cartridge needs to be replaced.

In the "ink empty" state, the ink cartridge contains no ink and the ink within the sub tank contains virtually no ink. For example, as illustrated in FIG. 13A, the LED of the operation panel 817 is made to turn ON in red to indicate the "ink empty" state with respect to the user. In addition, the panel display "Open Cartridge Cover" and the panel display "Replace Ink Cartridge" are alternately made on the operation panel 817 to indicate the "ink empty" state with respect to the user. In other words, in the "ink empty" state, the recording is not possible unless the ink cartridge is replaced.

Amongst the "normal", "ink near empty", and "ink empty" states, the recording instruction (or request) from the user may be accepted in the "normal" and "ink near empty" states.

On the other hand, in the operation mode to carry out the process illustrated in FIG. 10, the operating state (or status information) may be categorized into four (4) kinds, namely, "normal", "ink near empty", "ink empty", and "recording end" states. In the following description, the "normal", "ink near empty", "ink empty", and "recording end" states refer to the operating states, in the operation mode to carry out the process illustrated in FIG. 10.

In the "normal" state, both the ink cartridge and the sub tank contain ink, and the amount of ink within the ink cartridge is greater than a predetermined value that is based on product specifications. The predetermined value may be 10% as illustrated in FIG. 13B or, 20%, for example. In the "normal" state, as illustrated in FIG. 13B, the LED of the operation panel 817 is turned OFF to indicate the "normal" state, and the panel display "Recording Possible" is made on the operation panel 817 to indicate the "normal" state.

In the "ink near empty" state, the amount of ink within the ink cartridge is greater than zero (0) but less than or equal to the predetermined value, which is 10% in this example, but the sub tank contains ink. For example, as illustrated in FIG. 13B, the LED of the operation panel 817 is made to turn ON in yellow to indicate the "ink near empty" state with respect to the user. In addition, the panel display "Recording Possible" and the panel display "Ink Running Out" are alternately made on the operation panel 817 to indicate the "ink near empty" state with respect to the user. In other words, in the "ink near empty" state, the recording is possible but the ink cartridge needs to be replaced because the amount of ink within the ink cartridge is greater than zero (0) but less than or equal to the predetermined value.

In the "ink empty" state, the ink cartridge contains no ink (that is, the amount of ink within the ink cartridge is 0%) but the sub tank contains ink. For example, as illustrated in FIG. 13B, the LED of the operation panel 817 is made to blink at 3-second intervals in red to indicate the "ink empty" state with respect to the user. In addition, the panel display "Replace Ink Cartridge" and the panel display "Or Select Forced Recording" are alternately made on the operation panel 817 to indicate the "ink empty" state with respect to the user. In other words, in the "ink empty" state, the ink cartridge needs to be replaced but the forced recording is possible.

In the "recording end" state, the ink cartridge contains no ink (that is, the amount of ink within the ink cartridge is 0%) and the sub tank contains substantially no ink. For example, as illustrated in FIG. 13B, the LED of the operation panel 817 is made to turn ON in red to indicate the "recording end" state with respect to the user. In addition, the panel display "Open Cartridge Cover" and the panel display "Replace Ink Cartridge" are alternately made on the operation panel 817 to indicate the "recording end" state with respect to the user. In other words, in the "recording end" state, the recording is not possible unless the ink cartridge is replaced.

Amongst the "normal", "ink near empty", "ink empty", and "recording end" states, the recording instruction (or request) from the user may be accepted in the "normal" and "ink near empty" states. However, the recording requested from the user may be temporarily accepted in the "ink empty" state. In other words, the user may select the forced recording in the "ink empty" state.

Figure 14:
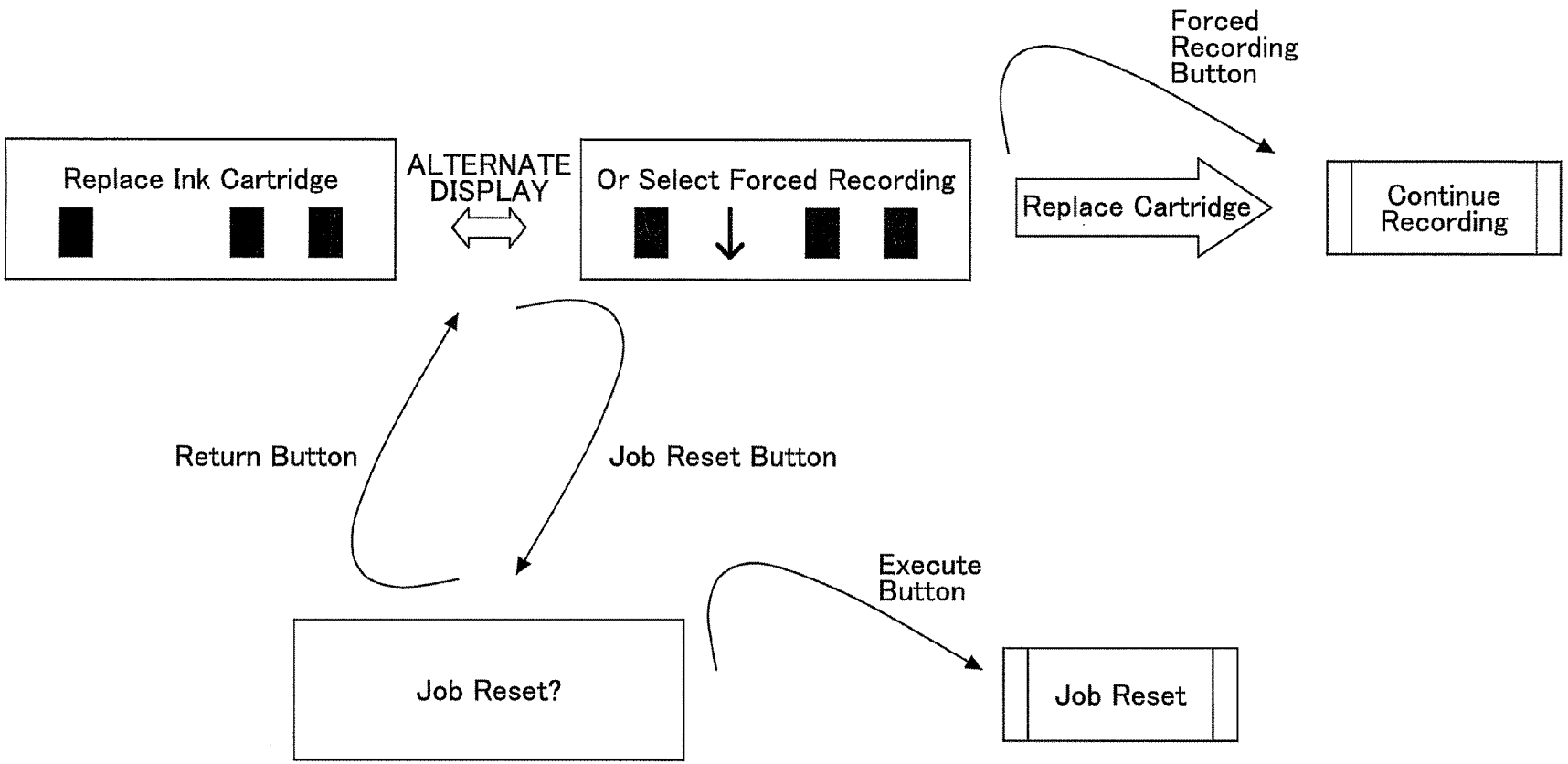
FIG. 14 is a diagram for explaining a user operation in the image forming apparatus.

FIG. 14 is a diagram for explaining a user operation in the image forming apparatus. In a case where the image forming apparatus in the "ink empty state" receives the recording request, that is, receives the recording request in the state where the forced recording is possible, the panel display "Replace Ink Cartridge" and the panel display "Or Select Forced Recording" are alternately made on the operation panel 817. The user may be notified that the forced recording is possible by making the panel display "Or Select Forced Recording".

In this state, the user may select the "Forced Recording" which temporarily enables the recording or, the "Job Reset" which cancels the recording or, the "Replace Ink Cartridge" which replaces the ink cartridge. The screen on the operation panel 817 on which this selection is made by pushing a corresponding button or key may be the same as that illustrated in FIG. 14 or, other screens may be used. If the "Forced Recording" button on the screen is selected, the image forming apparatus temporarily makes a transition from the recording disabled state to the recording enabled state and starts to record the image data requested by the user. If the "Job Reset" button on the screen is selected and an "Execute" button on the screen is selected in response to a message "Job Reset?" that is displayed, the image data requested by the user is discarded. If the "Replace Ink Cartridge" is selected and the ink cartridge is replaced, the image forming apparatus makes a transition from the recording disabled state to the recording enabled state and starts the recording.

Figure 15A:
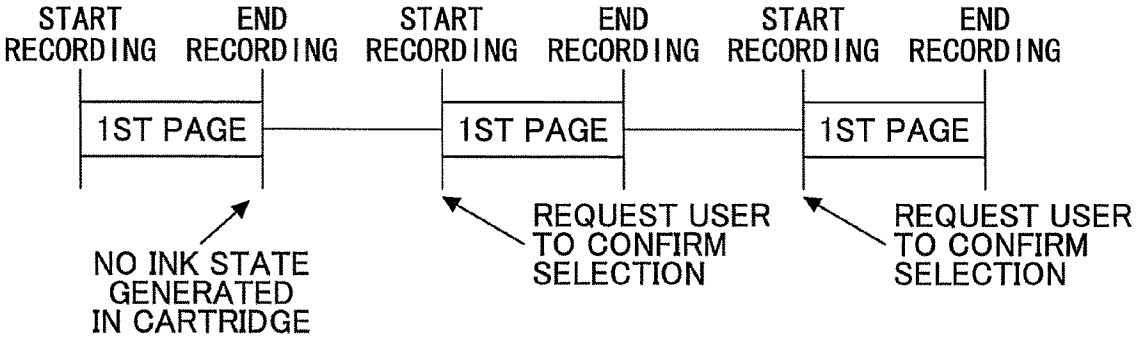
FIGS. 15A, 15B and 15C are diagrams for explaining selection request timings of the image forming apparatus.
Figure 15B:
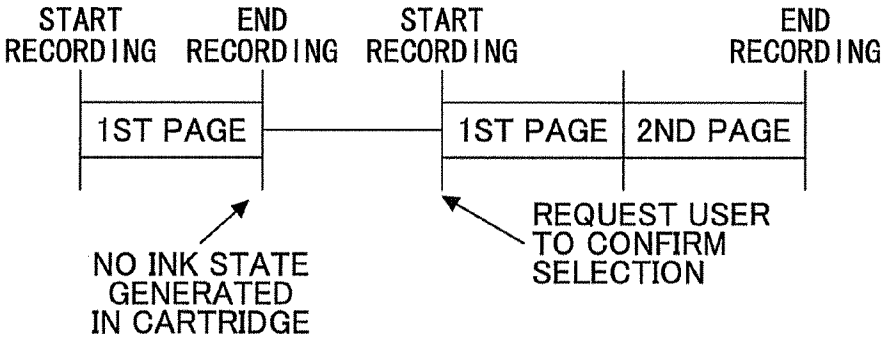
Figure 15C:
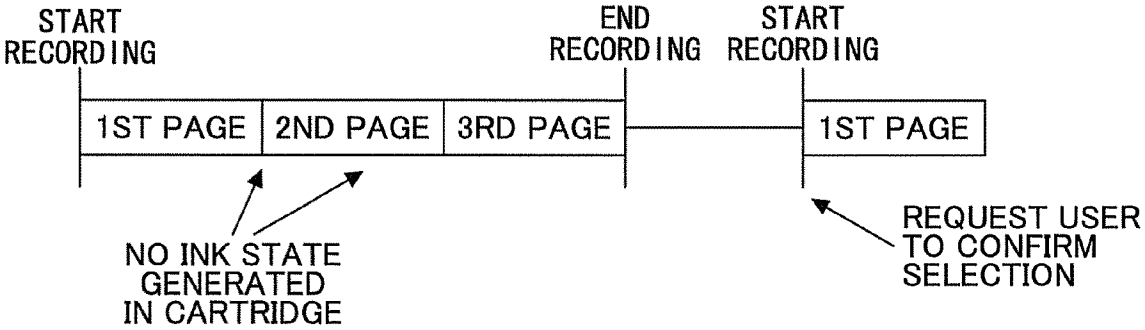

FIGS. 15A, 15B and 15C are diagrams for explaining selection request timings of the image forming apparatus. In other words, FIGS. 15A, 15B and 15C are diagrams for explaining the timings at which the user is urged to make the selection on whether to carry out the forced recording, by notifying the state where the ink cartridge has run out of ink, that is, the ink empty state, to the user.

As illustrated in FIG. 15A, when the "No Ink" state is generated in the ink cartridge, the user may be requested to confirm whether the forced recording is to be carried out or the ink cartridge is to be replaced, every time the image forming apparatus receives the record request. In the case of a continuous recording request that requests a plurality of pages to be recorded, the user may be requested only once to confirm whether the forced recording is to be carried out, as illustrated in FIG. 15B. In other words, instead of requesting the user to confirm whether to carry out the forced recording every time the recording of one page ends, the user may be requested to confirm whether to carry out the forced recording after all of the requested pages are recorded.

If the "No Ink" state of the ink cartridge is generated during the recording in response to the continuous recording request, the user may not be requested to confirm whether to carry out the forced recording, and the recording may be continued instead, as illustrated in FIG. 15C. Alternatively, the user may be requested to confirm whether to continue the recording or, to confirm whether to carry out the forced recording, during the recording.

Figure 16A:
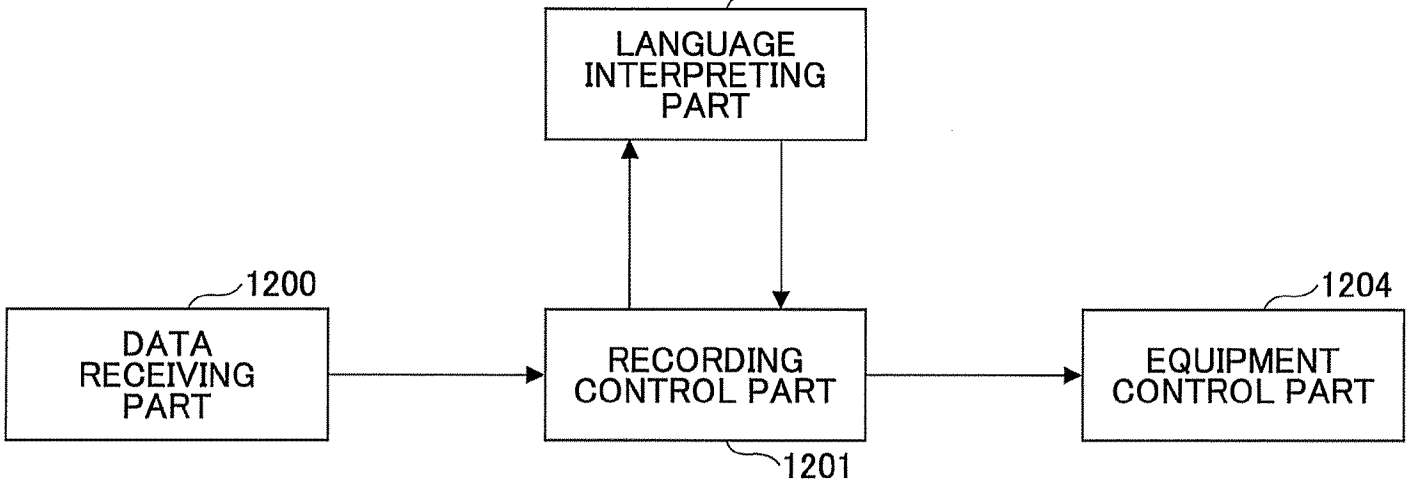
FIGS. 16A and 16B respectively are a functional block diagram and a flow diagram for explaining the recording control process of the image forming apparatus.
Figure 16B:
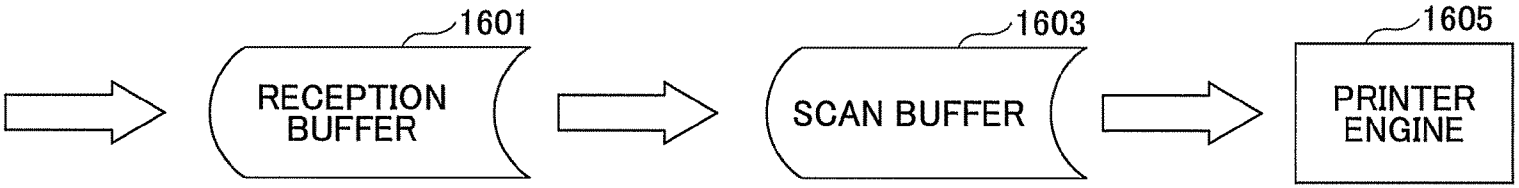

FIGS. 16A and 16B respectively are a functional block diagram and a flow diagram for explaining the recording control process of the image forming apparatus. The functional blocks illustrated in FIG. 16A may be formed by the microcomputer 801 illustrated in FIG. 8. In FIG. 16A, those parts that are the same as those corresponding parts in FIG. 12 are designated by the same reference numerals, and a description thereof will be omitted. FIG. 16B illustrates the flow of the image data.

When the user inputs the recording instruction via the application program 98, the OS (or GDI) 99 transmits the image data to be recorded to the printer driver 100. The printer driver 100 converts the image data received from the application program 98 into the recording image data having the format suited for the recording operation of the image forming apparatus, and inputs the recording image data to the microcomputer 801 via the communication circuit 101. More particularly, the recording image data is input to a recording control part 1201 via a data receiving part 1200 illustrated in FIG. 16A.

The data receiving part 1200 receives the recording image data, and writes the recording image data into a reception buffer 1601 illustrated in FIG. 16B. The data receiving part 1200 also notifies the recording request to the recording control part 1201. The reception buffer 1601 may not need to store all of the recording image data of one recording job, by carrying out a buffer management in units of predetermined blocks or a ring buffer management.

The recording control part 1201 requests a language interpreting part 1602 to process the recording image data written in the reception buffer 1601. The language interpreting part 1602 may convert the recording image data written in the reception buffer 1601 into taster data, and write the raster data into a scan buffer 1603. The scan buffer 1603 may function as a raster data storage unit or a raster data storage means that is configured to store the raster data.

For example, at least one of the reception buffer 1601 and the scan buffer 1603 may be formed by the non-volatile memory 816 illustrated in FIG. 8 or, an internal memory of the microcomputer 801.

The language interpreting part 1602 notifies the completion of band writing (that is, makes a band write complete notification) to the recording control part 1201 every time the writing of the raster data into the scan buffer 1603 in units of bands (that is, predetermined number of lines) is completed. In addition, the language interpreting part 1602 inquires the recording control part 1201 whether the writing of the raster data in units of bands into the scan buffer 1603 was successful, every time the writing of the raster data into the scan buffer 1603 in units of pages is completed. The language interpreting part 1602 stores a result of the inquiry, received from the recording control part 1201, in the non-volatile memory 816 or the like.

Upon receipt of the band write completion notification, the recording control part 1201 requests the equipment control part 1204 to transfer the raster data of the band. The equipment control part 1204 transfers the raster data of the band (or band data) from the scan buffer 1603 to a printer engine 1605 illustrated in FIG. 16B in order to record the band data on the recording medium 42. The printer engine 1605 includes the transport mechanism, the recording head part 134, and the like, to form the image of the requested image data on the recording medium 42. The scan buffer 1603 is managed by the recording control part 1201, and stores as much band data as possible depending on the storage capacity thereof. The band data stored in the scan buffer 1603 is released by the recording control part 1201 upon completion of the recording job.

Figure 17:
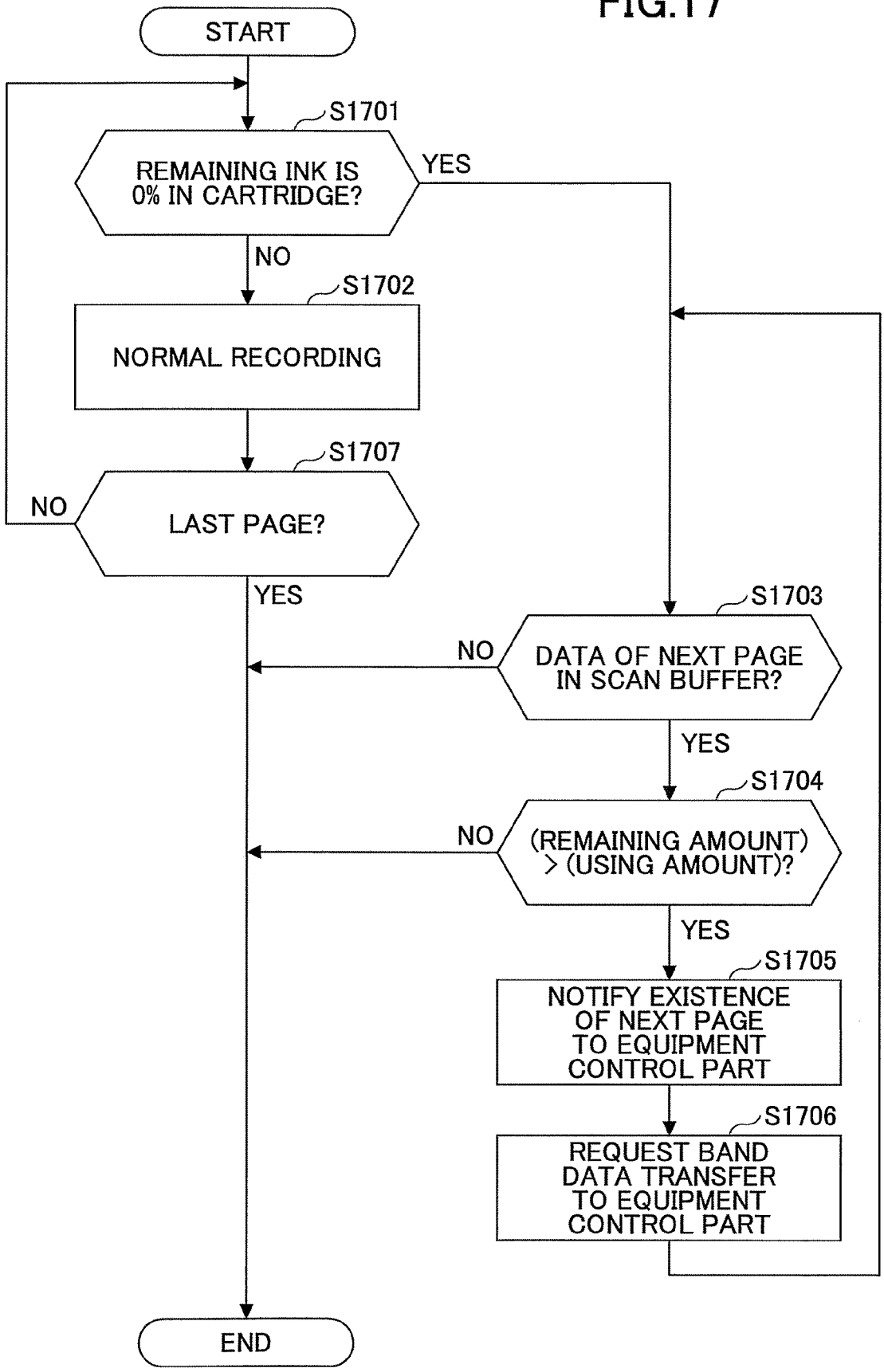
FIG. 17 is a flow chart for explaining a process of a recording control part of the image forming apparatus.

FIG. 17 is a flow chart for explaining a process of the recording control part 1201 of the image forming apparatus. The various computing described hereunder, including computing of the amount of ink required to record the image data, may be carried out by the microcomputer 801 which may function as a computing unit.

In FIG. 17, a step S1701 decides whether the amount of ink remaining within one of the ink cartridges 10*y*, 10*m*, 10*c*, and 10*k* is 0%. If the decision result in the step S1701 is NO, a step S1702 carries out a normal recording operation. After the step S1702, a step S1707 decides whether the last page of the recording job has been recorded. The process returns to the step S1701 if the decision result in the step S1707 is NO, in order to start recording the next page of the recording job. On the other hand, the process ends if the decision result in the step S1707 is YES.

On the other hand, if the amount of ink remaining within one of the ink cartridges 10*y*, 10*m*, 10*c*, and 10*k* is 0% and the decision result in the step S1701 is YES, a step S1703 decides whether the raster data of the next page to be recorded exists within the scan buffer 1605. The process ends if the decision result in the step S1703 is NO.

If the decision result in the step S1703 is YES, a step S1704 computes the amount of ink required to record the next page, with respect to the ink color for which the amount of ink remaining within the corresponding ink cartridge is 0%, and decides whether the computed amount of ink required to record the next page is less than the amount of ink of the same color remaining within the corresponding sub tank 35. The amount of ink remaining within the sub tank 35 may be detected by the level detection unit 35B (or the sensor 91). Hence, the amount of ink remaining within the ink cartridge may be the full state of the sub tank 35. The process ends if the decision result in the step S1704 is NO.

On the other hand, if the decision result in the step S1704 is YES, the next page may be recorded using the remaining ink within the sub tank 35. Hence, if the decision result in the step S1704 is YES, a step S1705 notifies the existing of the next page from the recording control part 1601 to the equipment control part 1602. A step S1706 requests the transfer of the band data from the recording control part 1601 to the equipment control part 1602, and the process returns to the step S1703. Hence, the step S1703 decides whether the raster data of the next to next page to be recorded exists within the scan buffer 1605.

The raster data written within the scan buffer 1605 is embedded with a 2-bit value indicating the size of the ink drop to be jetted from the recording head part 134, as illustrated in FIG. 18. FIG. 18 is a diagram for explaining the 2-bit value, that is, drop-size information, included in the raster data. Accordingly, the step S1704 in FIG. 17 may compute the amount of ink required to record the next page by counting or adding the number of each drop-size information (2-bit value) of the raster data related to the next page. As illustrated in FIG. 18, the drop-size information may indicate no ink drop (or no ink-jet), jetting of small ink drops, jetting of medium ink drops, and jetting of large ink drops, depending on the 2-bit values "00", "01", "10", and "11".

Figure 19:
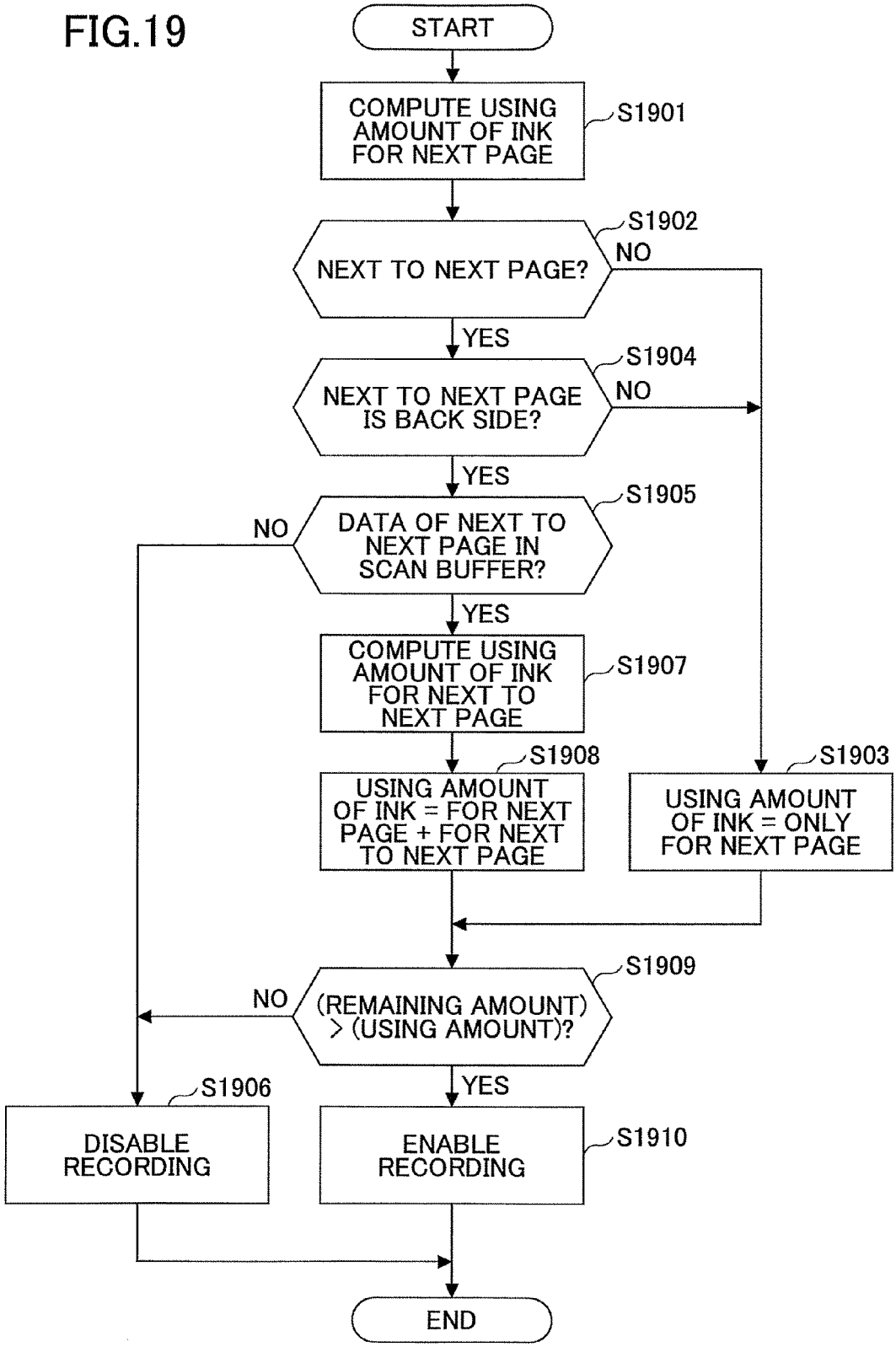
FIG. 19 is a flow chart for explaining a process of the recording control part in a duplex recording mode of the image forming apparatus.

FIG. 19 is a flow chart for explaining a process of the recording control part 1201 in a duplex recording mode of the image forming apparatus.

In FIG. 19, a step S1901 computes the amount of ink required to record on the next page, which is a front side of the recording medium 42, in the duplex recording mode, based on the raster data written in the scan buffer 1605 illustrated in FIG. 16A. A step S1902 decides whether the next to next page (that is, the page next to the next page) to be recorded exists in the recording request. If the decision result in the step S1902 is NO, a step S1903 regards the amount of ink required to record on the recording medium 42 as the amount of ink computed in the step S1901.

On the other hand, if the decision result in the step S1902 is YES, a step S1904 decides whether the next to next page to be recorded is the page to be recorded on a back side of the recording medium 42, opposite to the front side of the recording medium 42, in the duplex recording mode. If the decision result in the step S1904 is NO, the step S1903 regards the amount of ink required to record on the next page as the amount of ink computed in the step S1901.

If the decision result in the step S1904 is YES, a step S1905 decides whether the raster data of the next to next page to be recorded on the back side of the recording medium 42 exists in the scan buffer 1605. If the decision result in the step S1905 is NO, the amount of ink required to record the page on the back side of the recording medium 42 may not be computed, and thus, it is unclear whether the remaining amount of ink within the sub tank 35 may be sufficient to record the page on the back side of the recording medium 42. Hence, if the decision result in the step S1905 is NO, a step S1906 determines the state of the image forming apparatus to a recording disabled state (that is, disables the recording), and the process ends.

On the other hand, if the decision result in the step S1905 is YES, a step S1907 computes the amount of ink required to record the next to next page on the back side of the recording medium 42. In addition, a step S1908 computes the amount of ink required to record on the next recording medium 42, by adding the amount of ink required to record on the front side computed in the step S1901 and the amount of ink required to record on the back side computed in the step S1907.

A step S1909 decides whether the amount of ink required to record on the next recording medium 42 is less than the amount of ink of the same color remaining within the corresponding sub tank 35. The amount of ink remaining within the sub tank 35 may be detected in the manner described above. If the decision result in the step S1909 is NO, the step S1906 determines the state of the image forming apparatus to the recording disabled state, and the process ends. On the other hand, if the decision result in the step S1909 is YES, a step S1910 determines the state of the image forming apparatus to a recording enabled state (that is, enables the recording), and the process ends.

The ink of colors other than black, that is, the yellow, cyan and magenta ink in this example, may be mixed and used in place of the black ink. Hence, when the black ink within the black ink cartridge 10*k* runs out, the yellow, cyan and magenta ink within the ink cartridges 10*y*, 10*c* and 10*m* may be used as a substitute to compensate for the black ink that has run out.

Figure 20:
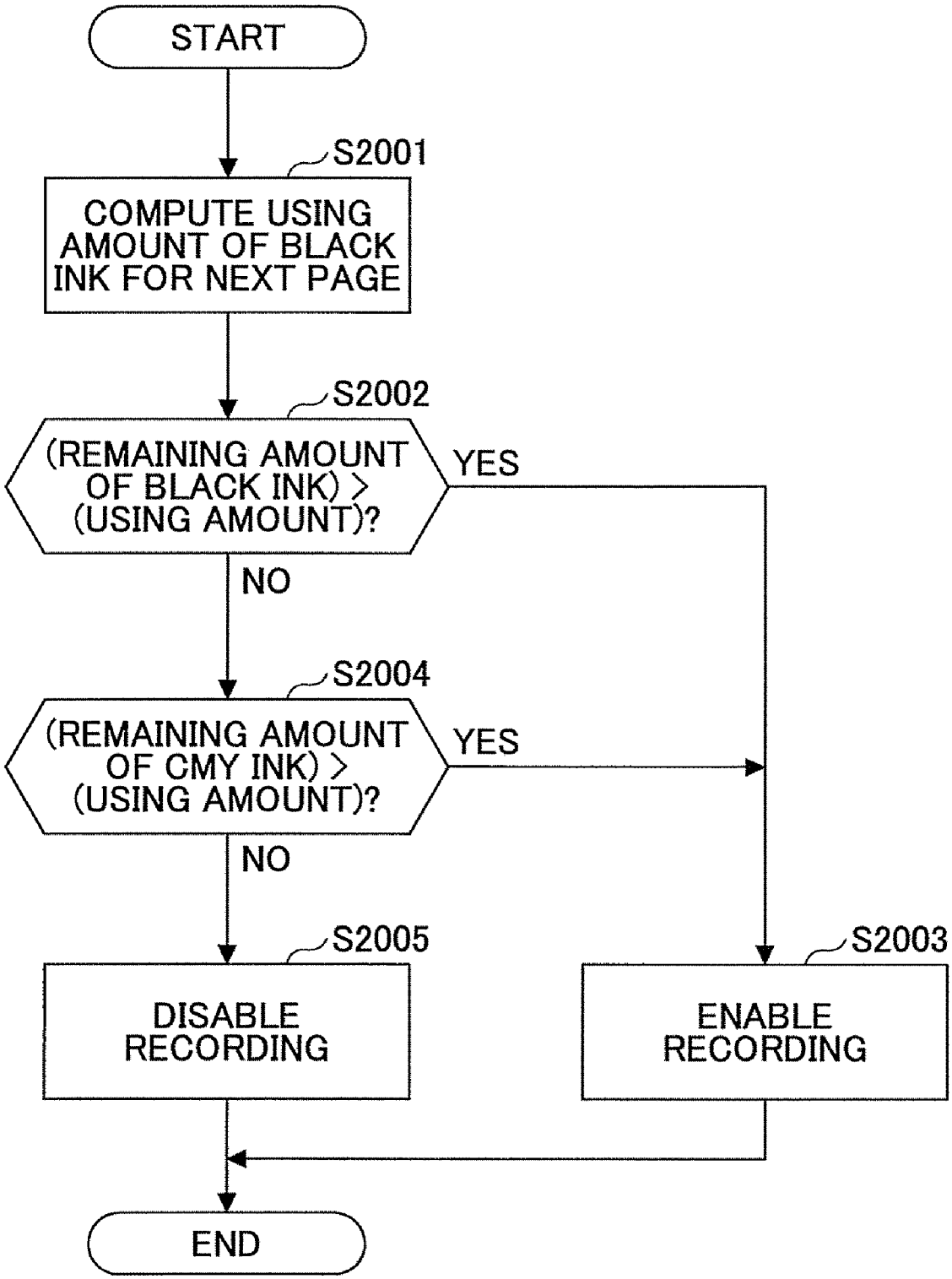
FIG. 20 is a flow chart for explaining a process of the recording control part of the image forming apparatus when using the ink of colors other than black to compensate for the black ink that has run out.

FIG. 20 is a flow chart for explaining a process of the recording control part 1201 of the image forming apparatus when using the ink of colors other than black to compensate for the black ink that has run out.

In FIG. 20, when the black ink within the ink cartridge 10*b* runs out, a step S2001 computes the amount of black ink required to record the next page, based on the raster data written in the scan buffer 1605. A step S2002 decides whether the amount of black ink required to record on the next page is less than the amount of black ink remaining within the corresponding sub tank 35. The amount of ink remaining within the sub tank 35 may be detected in the manner described above. If the decision result in the step S2002 is YES, a step S2003 determines the state of the image forming apparatus to a recording enabled state, and the process ends.

On the other hand, if the decision result in the step S2002 is NO, a step S2004 decides whether the amount of black ink required to record on the next page is less than the amount of cyan, magenta and yellow (CMY) ink within the ink cartridges 10*c*, 10*m* and 10*y* required to substitute for the black ink. If the decision result in the step S2004 is YES, the step S2003 determines the state of the image forming apparatus to a recording enabled state, and the process ends. If the decision result in the step S2004 is NO, a step S2005 determines the state of the image forming apparatus to a recording disabled state, and the process ends.

Figure 21:
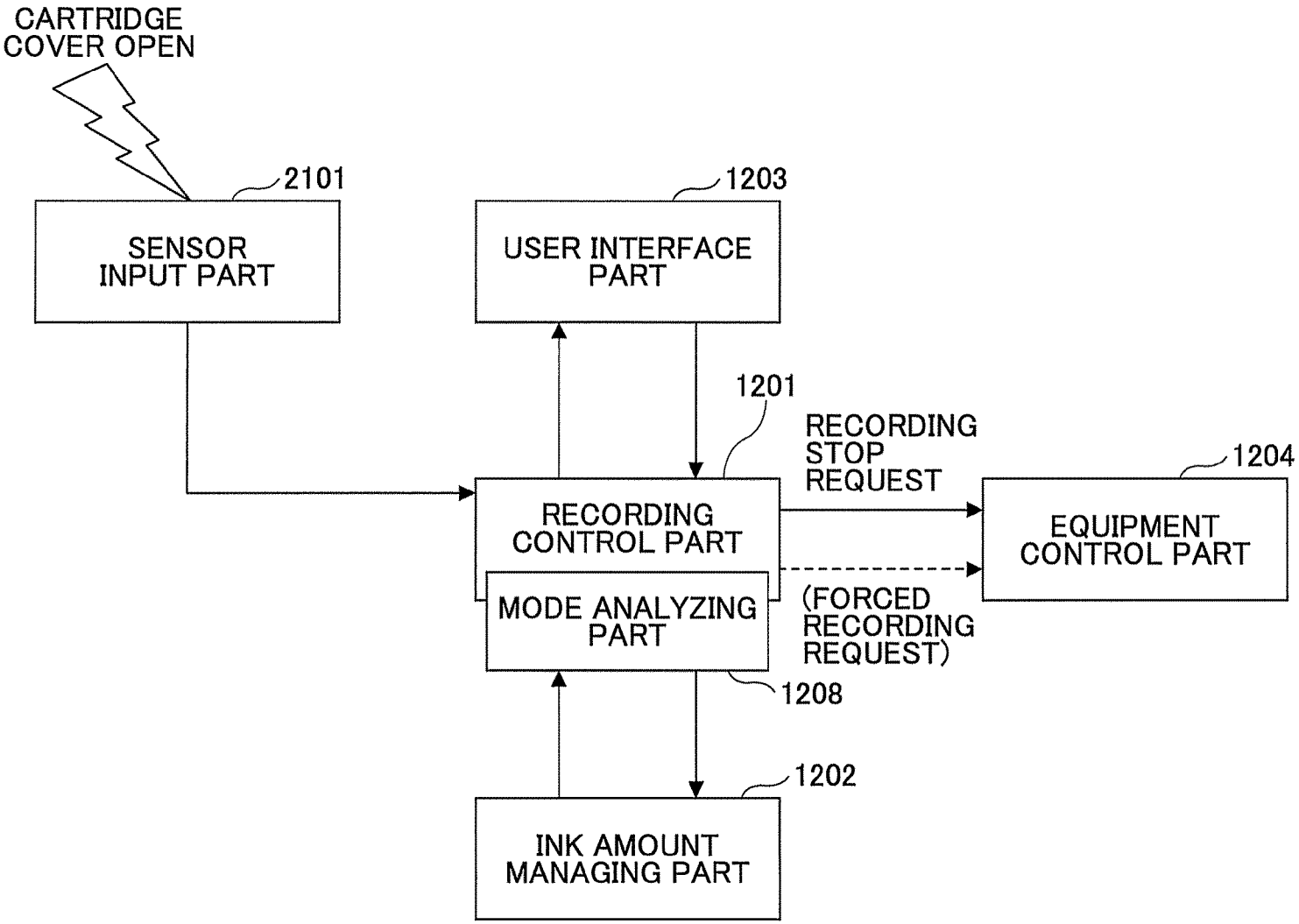
FIG. 21 is a functional block diagram for explaining a control process in a state where a cartridge cover of the image forming apparatus is opened.

FIG. 21 is a functional block diagram for explaining a control process in a state where the cartridge cover 10A of the image forming apparatus is opened. The functional blocks illustrated in FIG. 21 may be formed by the microcomputer 801 illustrated in FIG. 8. In FIG. 21, those parts that are the same as those corresponding parts in FIG. 12 are designated by the same reference numerals, and a description thereof will be omitted.

In this example, it is assumed for the sake of convenience that the cartridge cover 10A is opened during the recording operation, and the open cartridge cover 10A is detected by the cover sensor 814.

A detection signal output from the cover sensor 814, indicating the open state of the cartridge cover 10A, is input to a recording control part 1201 via a sensor input part 2101. The recording control part 1201 sends a recording stop request to an equipment control part 1204 in response to this detection signal from the sensor input part 2101 if the image forming apparatus is carrying out the recording operation. The equipment control part 1204 stops the recording operation in response to the recording stop request, and moves the recording head part 134 to the home position, for example. Thus, the image forming apparatus quickly stops the recording operation and makes a transition to the standby state, in order to prevent the ink from being jetted or leaking from the ink cartridges that are unloaded from the cartridge loading part 4 while the ink is still being supplied to the sub tank 35.

Next, a description will be given of the replacement of the ink cartridge during the forced recording, and how the empty state of the ink cartridge may be detected. A mode analyzing part 1208 within the recording control part 1201 illustrated in FIG. 21 analyzes the amount of ink remaining within the image forming apparatus, for each ink color, based on the information read from the non-volatile memory 115 of each ink cartridge and the information from the ink amount managing part 1202 that is configured to manage the remaining amount of ink within each sub tank 35. Because the information read from the non-volatile memory 115 of each ink cartridge includes the amount of ink remaining within the ink cartridge, the empty state of each ink cartridge may be detected from this information.

If the mode analyzing part 1208 detects an ink end state of the image forming apparatus in which both the ink cartridge and the sub tank 35 are empty for a certain ink color, the recording control part 1201 may select whether to accept the detection signal from the cover sensor 814 which detects the open state of the cartridge cover 10A, for example. In other words, the recording control part 1201 may select not to accept the detection signal from the cover sensor 814 when no ink is supplied from the ink cartridge to the corresponding recording head 34 during the recording operation of the requested recording job. On the other hand, when there is a possibility of supplying the ink from the ink cartridge to the corresponding recording head 34 during the recording operation of the requested recording job, the recording control part 1201 may select to accept the detection signal from the cover sensor 814.

If the recording control part 1201 detects the ink end state of the image forming apparatus for at least one ink color, the recording control part 1201 sends the recording stop request to the equipment control part 1204 in order to restrict the driving of the pump driving circuit 812 and prohibit the supply of ink from all of the ink cartridges 10*y*, 10*c*, 10*m*, and 10*k*. In other words, when the ink end state of the image forming apparatus is detected for at least one ink color, the supply of ink is prohibited from all of the ink cartridges 10*y*, 10*c*, 10*m*, and 10*k*.

By prohibiting the supply of ink from all of the ink cartridges 10*y*, 10*c*, 10*m*, and 10*k*, the supply of the ink to the corresponding sub tank 35 may be prohibited during the recording operation. For this reason, even if the cartridge cover 10A is opened during the recording operation, the ink may be prevented from being jetted or leaking from each of the ink cartridges 10*y*, 10*c*, 10*m*, and 10*k*. Consequently, operation of the image forming apparatus may not be stopped in order to replace the ink cartridge. In other words, the recording control part 1201 may decide whether to send the recording stop request to the equipment control part 1204 based on the detection of the ink end state made therein or, based on a user request, for example. As a result, the operation of the image forming apparatus may not be stopped when replacing the ink cartridge, so that the operation efficiency of the image forming apparatus may be improved.

In this example, the single cartridge cover 10A covers all of the ink cartridges 10*y*, 10*c*, 10*m*, and 10*k*. However, a cartridge cover may be provided with respect to two or more ink cartridges. In this case, if the ink end state is detected for the ink color of the ink cartridge covered by a first cartridge cover, for example, measures may be taken so that the ink of the ink cartridge covered by a different, second cartridge cover may be supplied to the corresponding sub tank 35 before the supply of the ink from all of the ink cartridges 10*y*, 10*c*, 10*m*, and 10*k* is prohibited.

The ink end state may be detected when the amount of ink remaining within the ink cartridge is low, instead of when the ink has run out. In this case, it may be possible to simultaneously detect the ink end state for two or more ink colors, in order to avoid a situation in which the user must replace two or more ink cartridges at relatively short intervals.

Furthermore, while the supply of ink from all of the ink cartridges 10*y*, 10*c*, 10*m*, and 10*k* is prohibited in the above described manner, the recording operation may be continued using the ink in the sub tanks 35 because the operation of the image forming apparatus may not be stopped. Hence, the ink cartridge may be replaced while the recording operation using the ink in the sub tanks 35 is being carried out.

Of course, the supply of ink from each ink cartridge may be prohibited when the "ink empty state" described above in conjunction with FIG. 13B is detected, in which the amount of ink remaining within the ink cartridge is 0%.

In the example described above, the sub tank and the ink cartridge are provided with respect to each ink color. However, the sub tank may be omitted, to supply the ink from the ink cartridge directly to the recording head part, with respect to each ink color. In this case, a state where the amount of ink remaining in the ink cartridge approaches a predetermined amount may be detected in place of detecting the state where the ink cartridge has run out of ink in the case where the sub tank is provided, by setting the predetermined amount equal to the amount of ink storable in the sub tank, with respect to each color ink. In other words, detecting for each color ink that the amount of ink remaining in the ink cartridge and thus remaining in the image forming apparatus has approached (or has become equal to) the predetermined amount in the case where no sub tank is provided may be equivalent to detecting for each color ink that the ink cartridge has run out of ink in the case where the sub tank is provided.

The processes and operations of the image forming apparatus described above may be achieved using the hardware described above or, by software or, by a combination of the hardware and software.

The software may be formed by a computer program which, when executed by a computer, such as the microcomputer 801, causes the computer to carry out the processes and operations described above. The program may be stored in a suitable computer-readable storage medium. The computer-readable storage medium may include, and is not limited to, magnetic recording media including magnetic disks which may be flexible disks or hard disks, optical recording media including CDs (Compact Disks) and DVDs (Digital Versatile Disks), magneto-optical recording media including MO (Magneto-Optical) disks, and semiconductor devices including ROMs (Read Only Memories), RAMs (Random Access Memories), flash memories, and USB (Universal Serial Bus) devices.

The computer-readable storage medium may include portable recording media or removable recording media, such as the disks described above. The program stored in the portable or removable recording medium may be provided in the form of package software.

The computer-readable storage medium may be embedded within dedicated hardware. In addition, the program may be installed or pre-installed in the computer-readable storage medium. The program may be downloaded to the computer from a site via a cable network and/or a wireless network, including LANs (Local Area Networks) and the Internet.

Further, the present invention is not limited to these embodiments, but various variations and modifications may be made without departing from the scope of the present invention.

What is claimed is:

1. An image forming apparatus comprising:

a replaceable ink cartridge configured to store ink;

a recording head;

a sub tank configured to store the ink supplied from the ink cartridge and to supply the ink to the recording head;

an ink amount managing unit configured to manage a remaining amount of ink remaining within each of the ink cartridge and the sub tank;

a storage unit configured to store raster data of image data to be recorded for a recording job;

a computing unit configured to compute an amount of ink to be used to record the raster data stored in the storage unit when the remaining amount of ink within the ink cartridge managed by the ink amount managing unit reaches a predetermined amount; and a recording control unit configured to enable the recording when the remaining amount of ink within the sub tank managed by the ink amount managing unit is greater than the amount of ink computed by the computing unit, and to disable the recording when the remaining amount of ink within the sub tank managed by the ink amount managing unit is less than or equal to the amount of ink computed by the computing unit.

2. The image forming apparatus as claimed in claim 1, wherein the computing unit computes the amount of ink to be used to record the raster data when the amount of ink remaining within the ink cartridge, managed by the managing unit, runs out.

3. The image forming apparatus as claimed in claim 2, further comprising:

an input unit configured to receive a selection when the recording control unit enables the recording, wherein the selection instructs one of a replacement of the ink cartridge, a forced recording of one page, and a cancellation of the recording job.

4. The image forming apparatus as claimed in claim 3, wherein the recording control unit stops supply of the ink from the ink cartridge to the sub tank when the selection received by the input unit instructs the forced recording of one page.

5. The image forming apparatus as claimed in claim 3, wherein the recording control unit supplies the ink from the ink cartridge to the sub tank before stopping supply of the ink from the ink cartridge to the sub tank when the selection received by the input unit instructs the forced recording of one page.

6. The image forming apparatus as claimed in claim 3, wherein the recording control unit stops supply of the ink from the ink cartridge to the sub tank when the selection received by the input unit instructs the forced recording of one page, based on a remaining amount of ink within the ink cartridge notified therefrom and the amount of ink remaining within the sub tank.

7. The image forming apparatus as claimed in claim 3, wherein the recording control unit prohibits use of the ink within the sub tank for operations other than the recording when the selection received by the input unit instructs the forced recording of one page.

8. The image forming apparatus as claimed in claim 3, wherein the input unit makes a display urging input of the selection every time the raster data amounting to one page is recorded on a recording medium.

9. The image forming apparatus as claimed in claim 3, wherein the inputting unit makes a display urging input of the selection every time the raster data amounting to one recording job is recorded on one or more recording media.

10. The image forming apparatus as claimed in claim 3, wherein the inputting unit makes a display urging input of the selection every time the raster data amounting to a front side, and a back side of a recording medium, opposite to the front side, is recorded in a duplex recording mode.

11. The image forming apparatus as claimed in claim 1, wherein the raster data include information indicating an ink dot size with respect to each dot of the image data, and the computing unit computes the amount of ink to be used to record the raster data based on the information indicating the ink dot size.

12. The image forming apparatus as claimed in claim 1, wherein the computing unit computes the amount of ink to be used to record the raster data of a front side, and a back side of a recording medium, opposite to the front side, in a duplex recording mode.

13. The image forming apparatus as claimed in claim 1, wherein the computing unit computes an amount of black ink to be used to record the raster data stored in the storage unit when the remaining amount of black ink within the sub tank managed by the ink amount managing unit reaches a predetermined amount, and computes an amount of ink of other colors to be used to record the raster data in place of using the black ink based on the amount of black ink computed by the computing unit.

14. An image formation enabling or disabling method to enable or disable recording of image data for a recording job in an image forming apparatus, comprising:

managing a remaining amount of ink remaining within each of a replaceable ink cartridge and a sub tank;

storing raster data of image data to be recorded for a recording job in a storage unit;

computing an amount of ink to be used to record the raster data stored in the storage unit when the managed remaining amount of ink within the ink cartridge reaches a predetermined amount; and enabling the recording when the managed remaining amount of ink within the sub tank is greater than the computed amount of ink, and disabling the recording when the managed remaining amount of ink within the sub tank is less than or equal to the computed amount of ink.

15. The image formation enabling or disabling method as claimed in claim 14, further comprising:

storing ink in the ink cartridge; and storing the ink supplied from the ink cartridge in the sub tank and supplying the ink to a recording head, wherein the computing computes the amount of ink to be used to record the raster data when the amount of ink remaining within the ink cartridge, managed by the managing, runs out.

16. The image formation enabling or disabling method as claimed in claim 14, wherein:

the raster data includes information indicating an ink dot size with respect to each dot of the image data, and the computing computes the amount of ink to be used to record the raster data based on the information indicating the ink dot size.

17. A non-transitory computer-readable storage medium which stores a program which, when executed by a computer, causes the computer of an image forming apparatus to carry out an image formation enabling or disabling process, the process comprising:

a managing procedure causing the computer to manage a remaining amount of ink remaining within each of a replaceable ink cartridge and a sub tank;

a storing procedure causing the computer to store raster data of image data to be recorded for a recording job in a storage unit;

a computing procedure causing the computer to compute an amount of ink to be used to record the raster data stored in the storage unit when the remaining amount of ink within the ink cartridge, managed by the managing procedure, reaches a predetermined amount; and a recording enabling and disabling procedure causing the computer to enable the recording when the remaining amount of ink within the sub tank, managed by the managing procedure, is greater than the computed amount of ink, and to disable the recording when the remaining amount of ink within the sub tank, managed by the managing procedure, is less than or equal to the computed amount of ink.

18. The non-transitory computer-readable storage medium as claimed in claim 17, wherein the process further comprises:

a procedure causing the computer to store ink supplied from the ink cartridge to the sub tank and to supply the ink from the sub tank to a recording head, wherein the computing procedure computes the amount of ink to be used to record the raster data when the amount of ink remaining within the ink cartridge, managed by the managing procedure, runs out.

19. The non-transitory computer-readable storage medium as claimed in claim 18, wherein the process further comprises:

a receiving procedure causing the computer to receive a selection when the enabling and disabling procedure enables the recording, wherein the selection is one of a replacement of the ink cartridge, a forced recording of one page, and a cancellation of the recording job.

20. The non-transitory computer-readable storage medium as claimed in claim 19, wherein the recording enabling and disabling procedure stops supply of the ink from the ink cartridge to the sub tank when the selection received by the receiving procedure instructs the forced recording of one page, based on a remaining amount of ink within the ink cartridge notified therefrom and the amount of ink remaining within the sub tank.

* * * * *